US007869737B2

(12) United States Patent
Oda

(10) Patent No.: US 7,869,737 B2
(45) Date of Patent: Jan. 11, 2011

(54) DEVELOPER CARTRIDGE, DEVELOPING DEVICE AND IMAGE FORMING APPARATUS

(75) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/219,487

(22) Filed: Jul. 23, 2008

(65) Prior Publication Data

US 2009/0028600 A1 Jan. 29, 2009

(30) Foreign Application Priority Data

Jul. 25, 2007 (JP) ..... 2007-192745

(51) Int. Cl.
*G03G 15/08* (2006.01)

(52) U.S. Cl. ..... 399/106; 399/262; 277/496; 277/459

(58) Field of Classification Search ..... 399/106
See application file for complete search history.

(56) References Cited

U.S. PATENT DOCUMENTS 5,513,857 A * 5/1996 Watanabe et al. ..... 277/469
6,324,371 B1 * 11/2001 Okiyama et al. ..... 399/262
2004/0161267 A1 * 8/2004 Ichikawa et al. ..... 399/262
2006/0055120 A1 * 3/2006 Umetsu et al. ..... 277/459
2007/0290402 A1 * 12/2007 Edwards ..... 264/259

FOREIGN PATENT DOCUMENTS

| | | |
|---|---|---|
| JP | 5-27767 | 4/1993 |
| JP | 11-272071 | 10/1999 |
| JP | 2001-42620 | 2/2001 |
| JP | 2003-84549 | 3/2003 |
| JP | 2005-37470 | 2/2005 |
| JP | 2005-227614 | 8/2005 |

* cited by examiner

*Primary Examiner*—David M Gray
*Assistant Examiner*—Roy Yi
(74) *Attorney, Agent, or Firm*—Rabin & Berdo, PC

(57) ABSTRACT

A developer cartridge includes a storing portion that stores developer and has an opening, a shutter member that opens and closes the opening, and a seal member that seals between the shutter member and the storing portion. The seal member is so provided that both end portions thereof face each other. One end portion of the seal member has at least one angled portion provided inside both side end edges of the seal member in width direction of the seal member, and the other end portion has an angled portion along the angled portion of said one end portion.

22 Claims, 20 Drawing Sheets

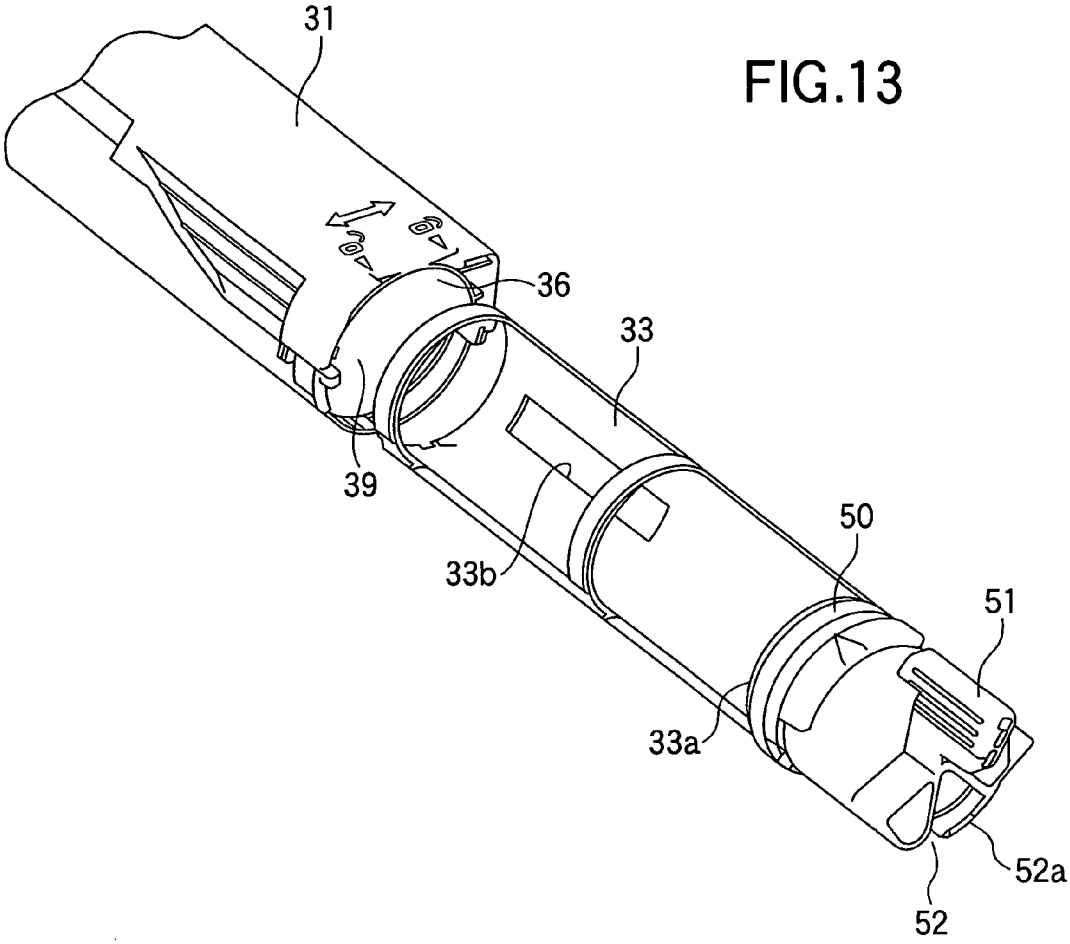
FIG.13
FIG.14
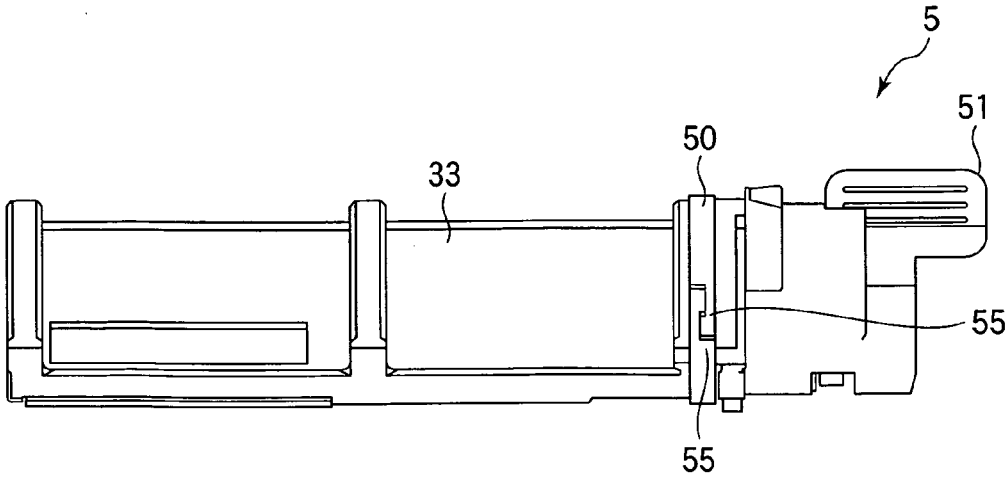

DEVELOPER CARTRIDGE, DEVELOPING DEVICE AND IMAGE FORMING APPARATUS

BACKGROUND OF THE INVENTION

This invention relates to an image forming apparatus using electrophotography, and relates to a developing device and a developer cartridge used in the image forming apparatus.

An image forming apparatus using electrophotography such as a printer, a copier, a facsimile or the like is configured to form a toner image by uniformly charging a surface of a photosensitive body, exposing the charged surface of the photosensitive body to thereby form a latent image, developing the latent image with toner (developer), and transferring the toner image to a recording medium. The toner image is fixed to the recording medium by application of heat and pressure. Residual toner remaining on the surface of the photosensitive body is removed by a cleaning device.

A toner cartridge is mounted (for example, detachably mounted) to a developing device that performs developing. The toner cartridge includes a toner storing portion for storing unused toner which is to be supplied to the developing device and a waste toner storing portion for storing waste toner.

A toner supply opening is formed on the bottom of the toner storing portion for supplying the toner to the developing device. A cylindrical shutter for opening and closing the toner supply opening is provided inside the toner storing portion. A part of the cylindrical shutter protrudes to the outside through an opening formed on a side of the toner storing portion. A rotatable operation lever is provided on the outer part of the cylindrical shutter. By operating the rotatable operation lever, the toner cartridge is locked with respect to the developing device, and, at the same time, the cylindrical shutter is moved to open the toner supply opening. Such a toner cartridge is disclosed by, for example, Japanese Laid-open Patent Publication 2005-227614 (see, Pages 4-5 and FIG. 1).

Here, a seal member is attached to the outer circumferential surface of the cylindrical shutter, in order to seal between the outer circumferential surface of the cylindrical shutter and the inner circumferential surface of the toner storing portion. The seal member is strip-shaped (band-shaped), and an adhesive agent is coated on the backside of the seal member. The seal member is wound around the cylindrical shutter at one revolution in the circumferential direction of the cylindrical shutter. Both end portions of the seal member in the longitudinal direction thereof have inclined end edges which are inclined with respect to the longitudinal direction of the seal member. The seal member is wound around the cylindrical shutter in such a manner that the inclined end edges face each other.

SUMMARY OF THE INVENTION

The present invention is intended to provide a developer cartridge, a developing device and an image forming apparatus capable of preventing the leakage of a developer.

The present invention provides a developer cartridge including a storing portion that stores developer and has an opening, a shutter member that opens and closes the opening, and a seal member that seals between the shutter member and the storing portion. The seal member is so provided that both end portions thereof face each other. One end portion of the seal member has at least one angled portion inside both side end edges of the seal member in width direction of the seal member, and the other end portion has an angled portion along the angled portion of said one end portion.

The present invention also provides a developing device using the above described developer cartridge.

The present invention also provides an image forming apparatus including the above described developing device.

With such a configuration, even if a gap is formed between both end portions of the seal member, the angled portions of the end portions of the seal member prevent the passage of the developer, and leakage of the developer is prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 13 is a perspective view showing a shutter taken out of the toner cartridge according to the first embodiment;

FIG. 14 is a perspective view showing an outer shape of the shutter of the toner cartridge according to the first embodiment;

DETAILED DESCRIPTION OF THE PREFERRED EMBODIMENT

Figure 1:
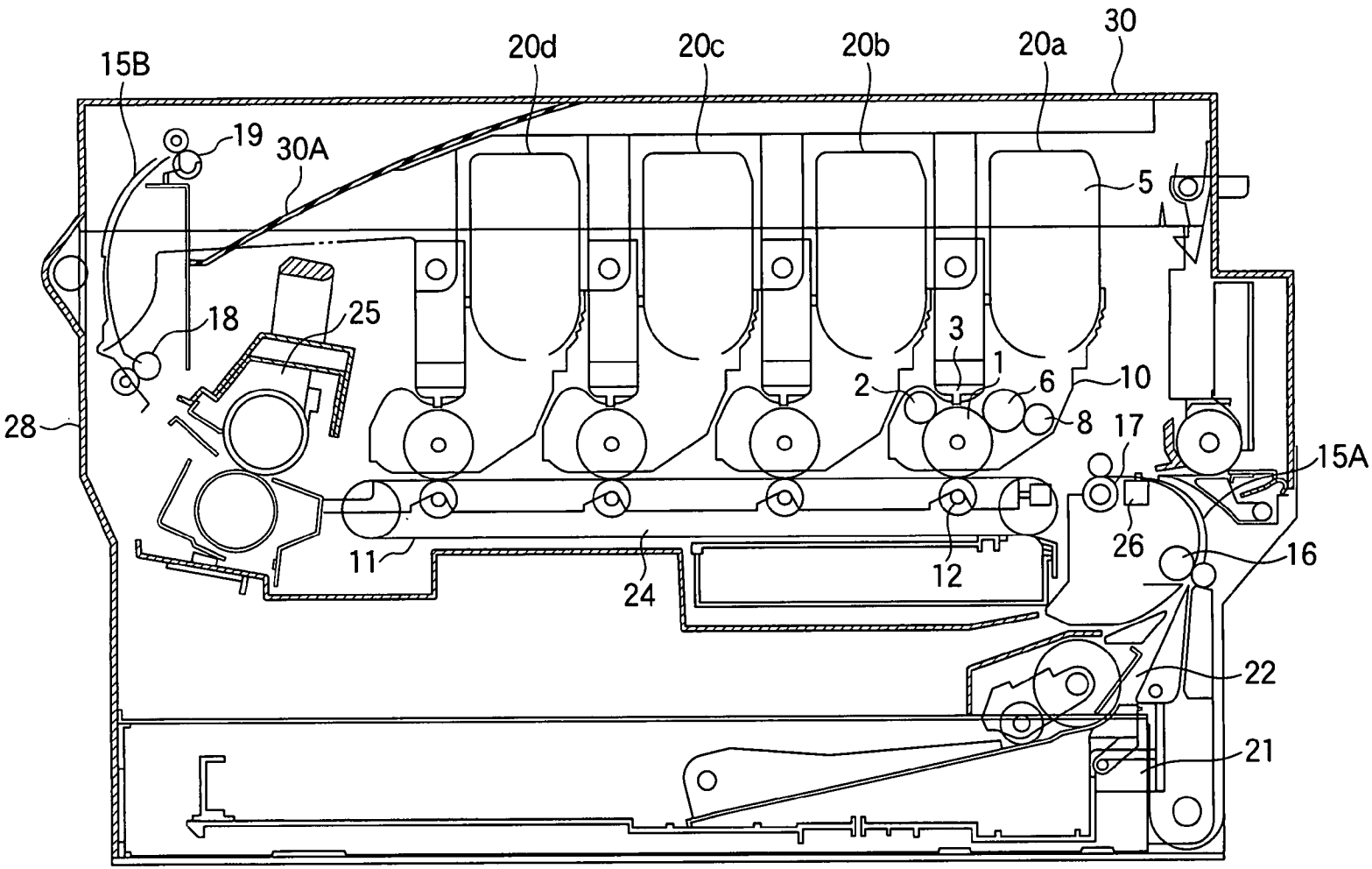
FIG. 1 shows a basic configuration of an image forming apparatus according to the first embodiment of the present invention.

FIG. 1 shows a basic configuration of an image forming apparatus according to the first embodiment of the present invention.

The image forming apparatus includes a casing composed of a lower frame 28 and an upper cover 30. A feed cassette 21, a pickup roller 22 and feed roller pairs 16 and 17 are disposed in the lower frame 28. The feed cassette 21 stores recording media. The pickup roller 22 feeds the recording medium individually out of the feed cassette 21. The feed roller pairs 16 and 17 feed the recording medium (supplied by the pickup roller 22) along a feeding path 15A.

The image forming apparatus further includes a transfer belt unit 24 having a transfer belt 11 that absorbs the recording medium (having been fed via the feeding path 15A) with electrostatic force and conveys the recording medium. Four image forming units 20*a*, 20*b*, 20*c* and 20*d* of black, yellow, magenta and cyan are disposed along a conveying path of the recording medium conveyed by the transfer belt 11. Transfer rollers 12 are disposed respectively facing the image forming units 20*a*, 20*b*, 20*c* and 20*d*.

A fixing unit 25 is disposed on the downstream side of the transfer belt unit 24 in the conveying direction of the recording medium. The fixing unit 25 is provided for fixing the toner image to the recording medium. Further, conveying roller pairs 18 and 19 are disposed on the downstream side of the fixing unit 25. The conveying roller pairs 18 and 19 convey the recording medium (to which the toner is fixed) along an ejection path 15B and eject the recording medium to a stacker portion 30A provided on the upper frame 30. The above described feeding path 15A, the conveying path (which is substantially horizontal) by the transfer belt 11 and the ejection path 15B are connected so as to make approximately "S" shape.

Figure 2:
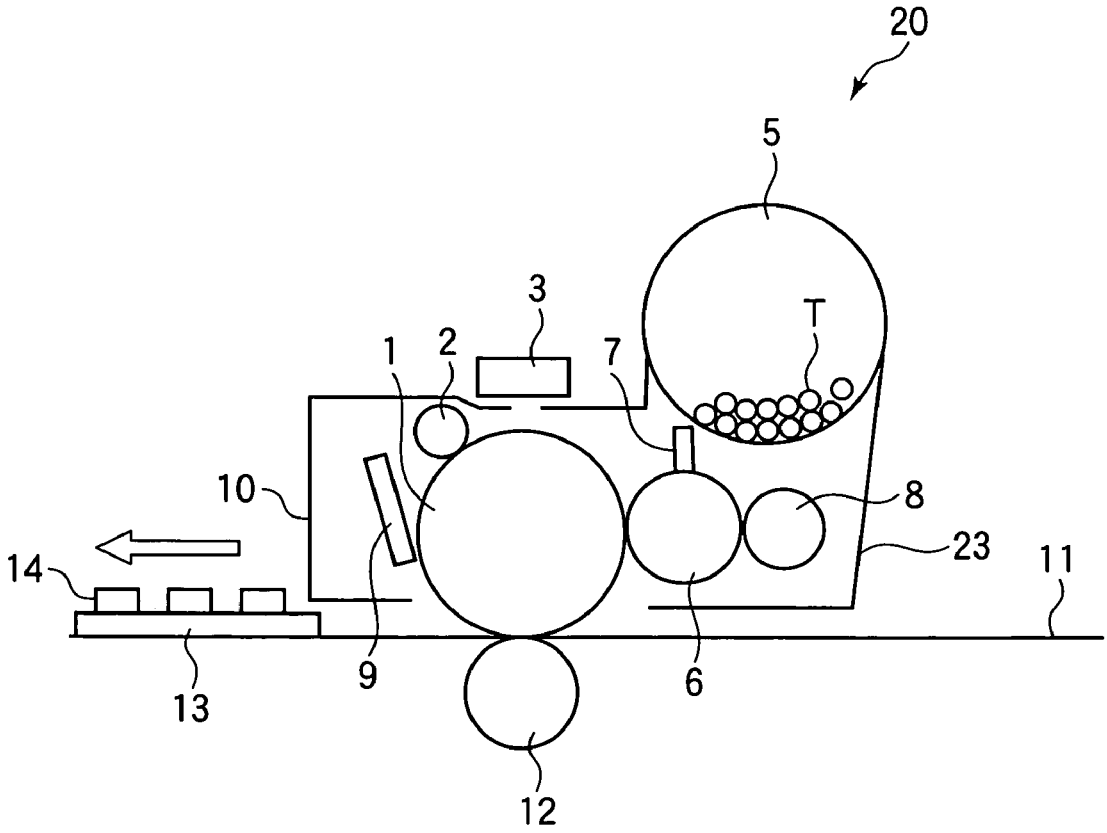
FIG. 2 is a schematic view showing a basic configuration of an image forming unit of the image forming apparatus according to the first embodiment.

FIG. 2 is a schematic view showing a basic configuration of the image forming unit 20 and the transfer roller 12. The image forming units 20*a*, 20*b*, 20*c* and 20*d* have the same configuration except the kinds of toners to be used, and therefore are collectively referred to herein as "the image forming unit 20".

The image forming unit 20 includes a photosensitive body (an image bearing body) 1 that has a substantially cylindrical shape (i.e., drum shape) and rotates at a predetermined speed. The photosensitive body 1 has a chargeable surface, and is so configured that electric charge on the surface can be removed by exposure.

A charging roller 2, an exposing device 3, a developing unit (i.e., a developing device) 23, a transfer roller 12 and a cleaning blade 9 are disposed along the rotational direction of the photosensitive body 1.

The charging roller 2 is applied with a predetermined voltage. The charging roller 2 is pressed against the surface of the photosensitive body 1 and rotates in the same direction as the photosensitive body 1, so as to uniformly charge the surface of the photosensitive body 1. The exposing device 3 is composed of, for example, an LED unit, and exposes the surface of the photosensitive body 1 according to image information to form a latent image.

The developing unit 23 is configured to develop the latent image formed on the surface of the photosensitive body 1 using toner (i.e., developer). The developing unit 23 includes a developing roller 6 that contacts the surface of the photosensitive body 1 with a constant pressure. A toner cartridge 5 storing unused toner (indicated by mark T in FIG. 2) is detachably attached to the upper part of the developing unit 23. The developing unit 23 further includes a toner supply roller 8 that supplies the toner from the toner cartridge 5 to the developing roller 6, and a developing blade 7 that regulates the thickness of the toner on the surface of the developing roller 6. The toner supply roller 8 and the developing blade 7 contact the surface of the developing roller 6 with constant pressure.

The transfer roller 12 is disposed so that the transfer belt 11 is sandwiched between the photosensitive body 1 and the transfer roller 12. The transfer belt 11 and the transfer roller 12 are applied with voltage (transfer bias) by not shown power sources, and transfer the toner image from the surface of the photosensitive body 1 to the recording medium 13.

The cleaning blade 9 is composed of a resilient body and contacts the surface of the photosensitive body 1 with a constant pressure so as to scrape off a residual toner from the surface of the photosensitive body 1. The conveying of the scraped-off toner will be described later.

Figure 3B:
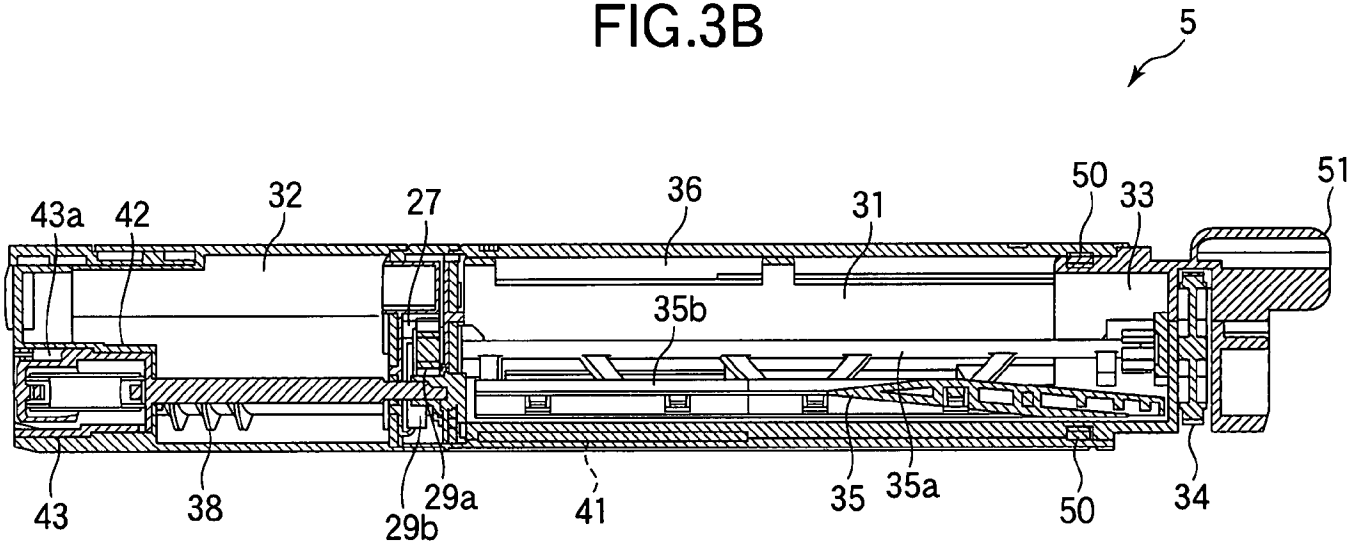
FIGS. 3A and 3B are a side view and a sectional view showing a toner cartridge of the first embodiment.
Figure 3C:
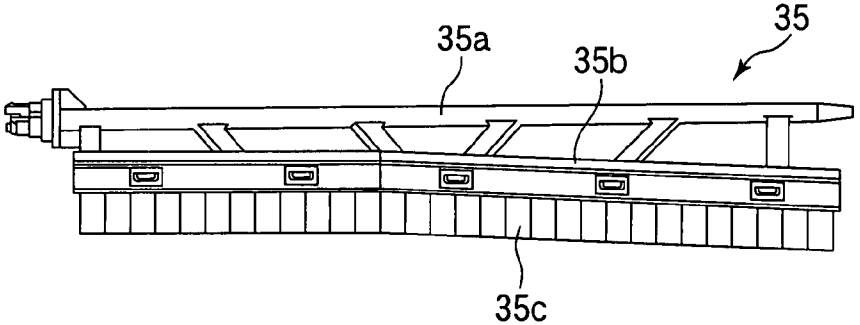
FIG. 3C shows an agitating member taken out of the toner cartridge.
Figure 3A:
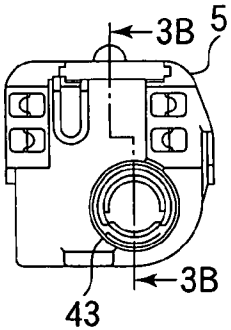
Figure 4:
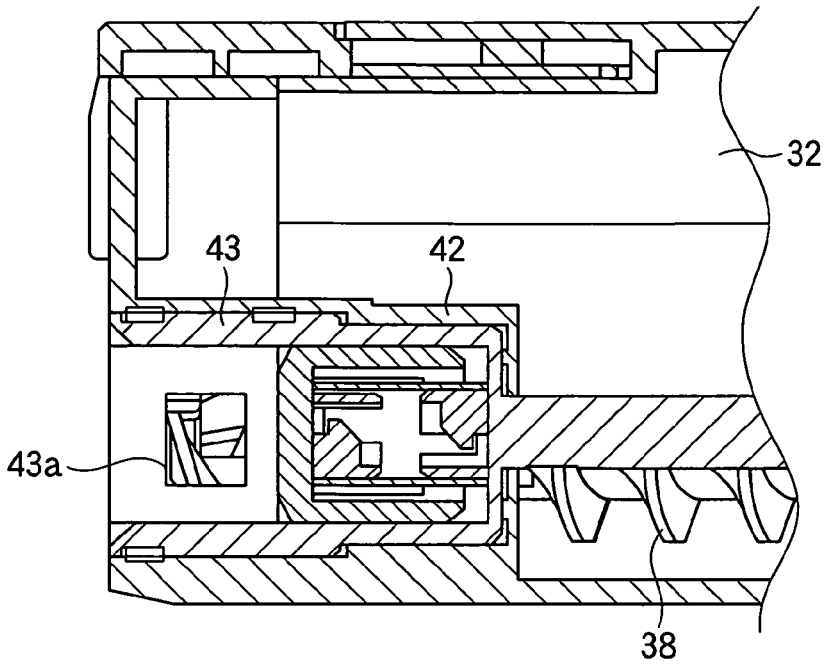
FIG. 4 is a sectional view showing a configuration of a waste toner receiving portion of the toner cartridge of FIGS. 3A and 3B.
Figure 5:
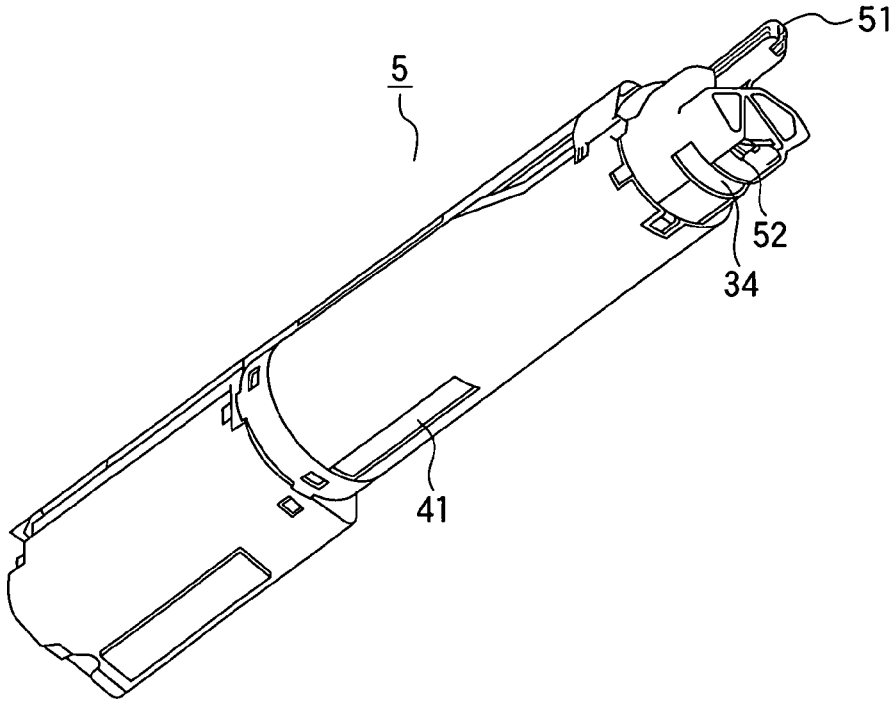
FIG. 5 is a perspective view showing the toner cartridge according to the first embodiment.
Figure 6:
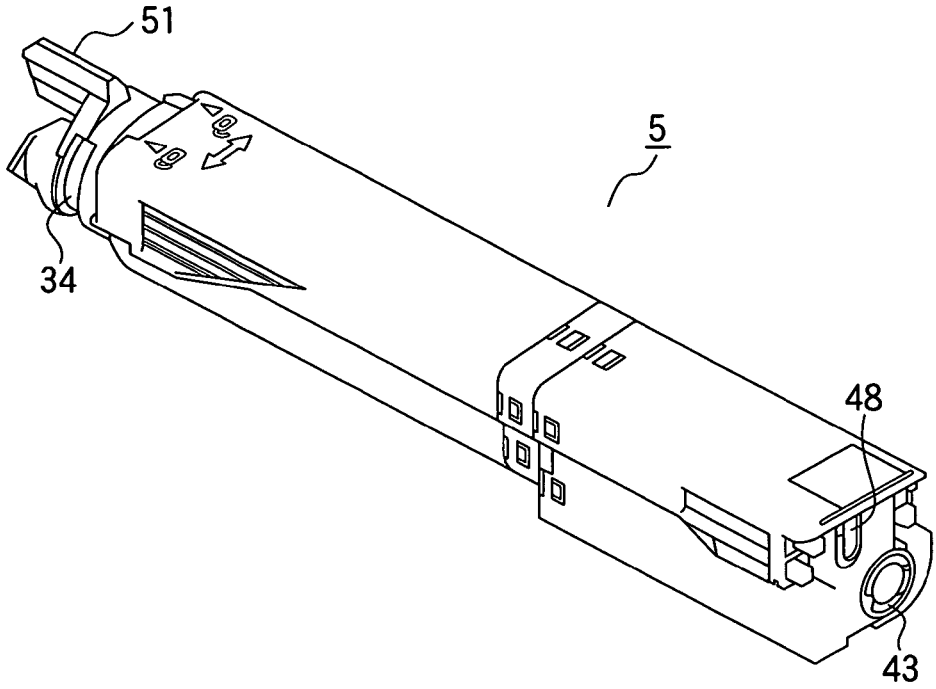
FIG. 6 is a perspective view showing the toner cartridge according to the first embodiment.
Figure 7:
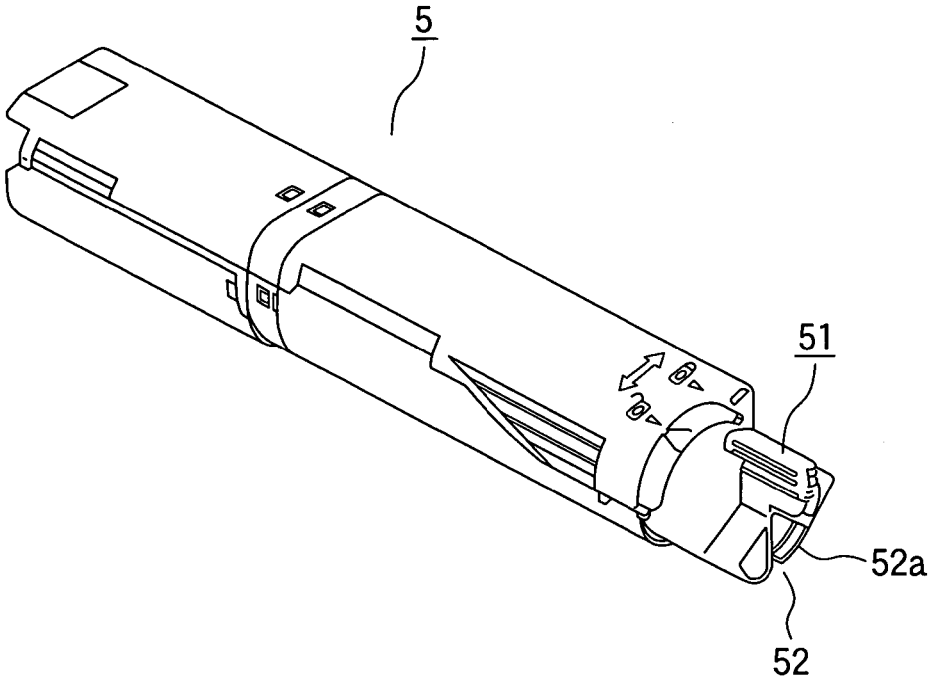
FIG. 7 is a perspective view showing the toner cartridge according to the first embodiment.
Figure 8:
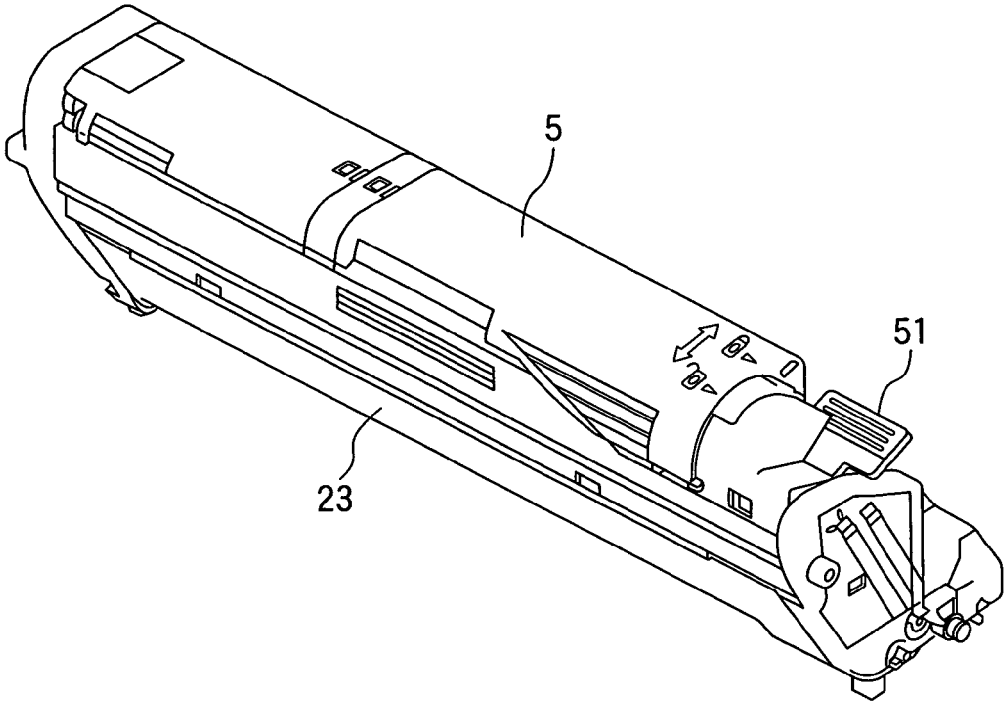
FIG. 8 is a perspective view showing a developing unit to which the toner cartridge according to the first embodiment is mounted.
Figure 9:
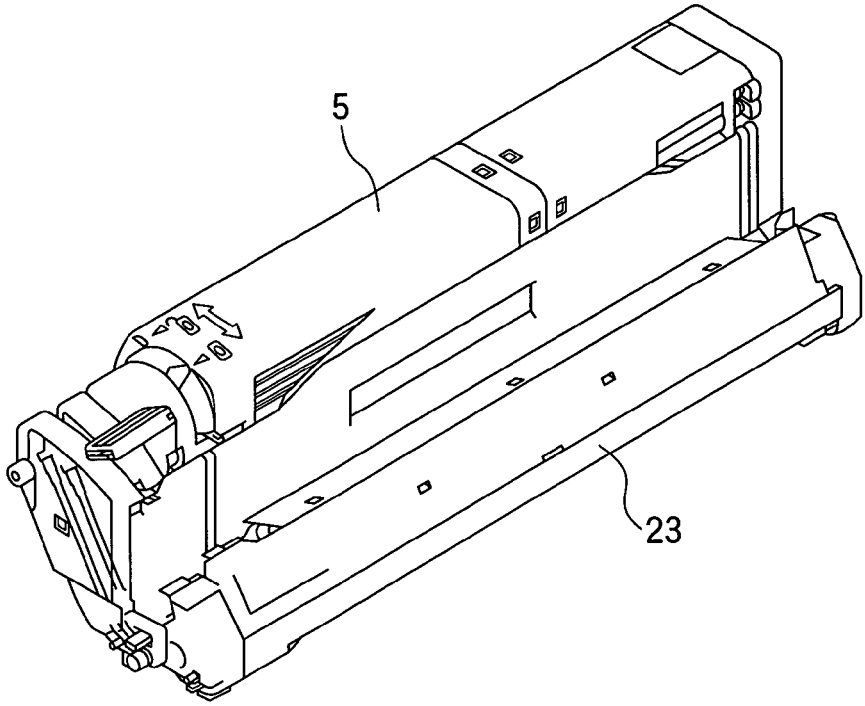
FIG. 9 is a perspective view showing the developing unit to which the toner cartridge according to the first embodiment is mounted.
Figure 10:
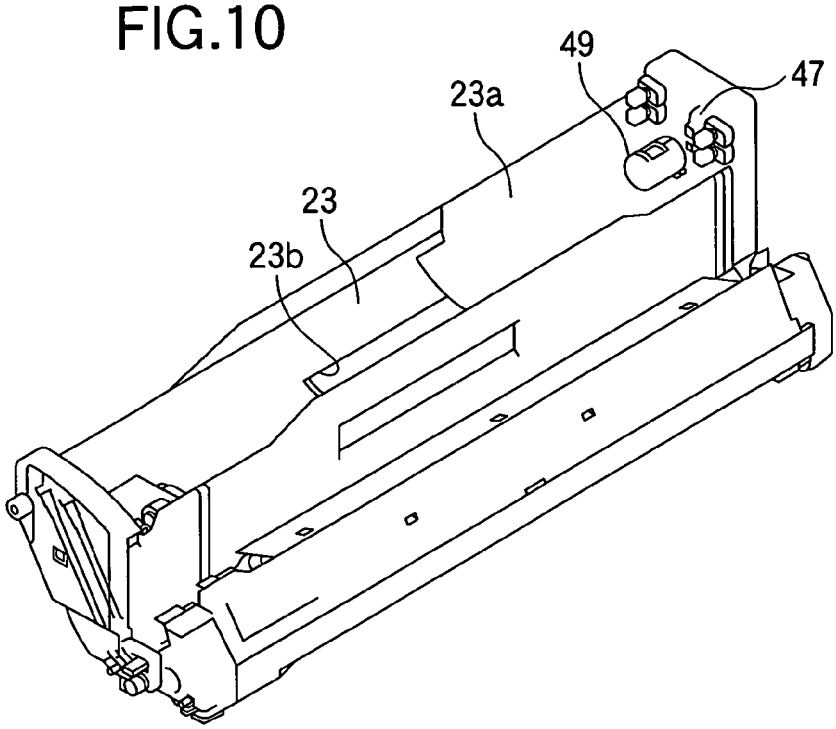
FIG. 10 is a perspective view showing the developing unit to which the toner cartridge according to the first embodiment is not mounted.
Figure 11:
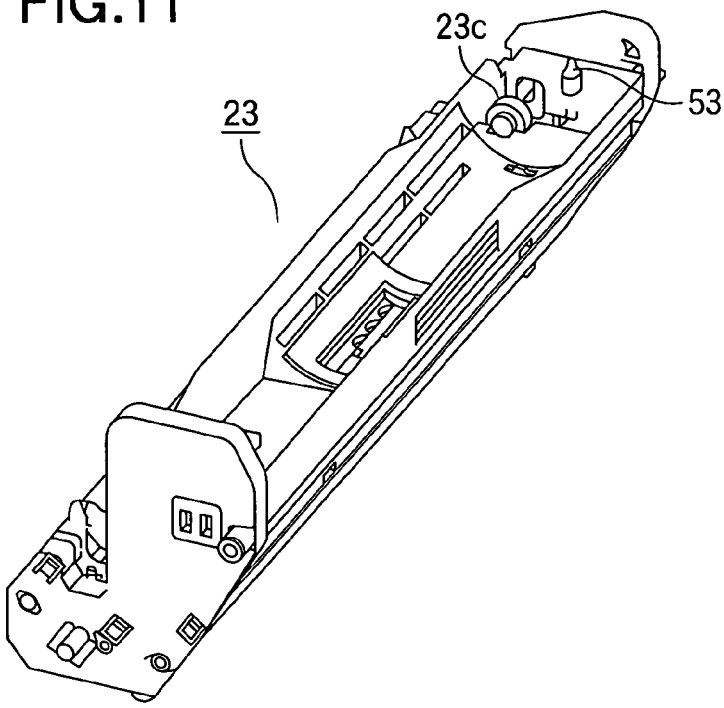
FIG. 11 is a perspective view showing the developing unit to which the toner cartridge according to the first embodiment is not mounted.
Figure 12:
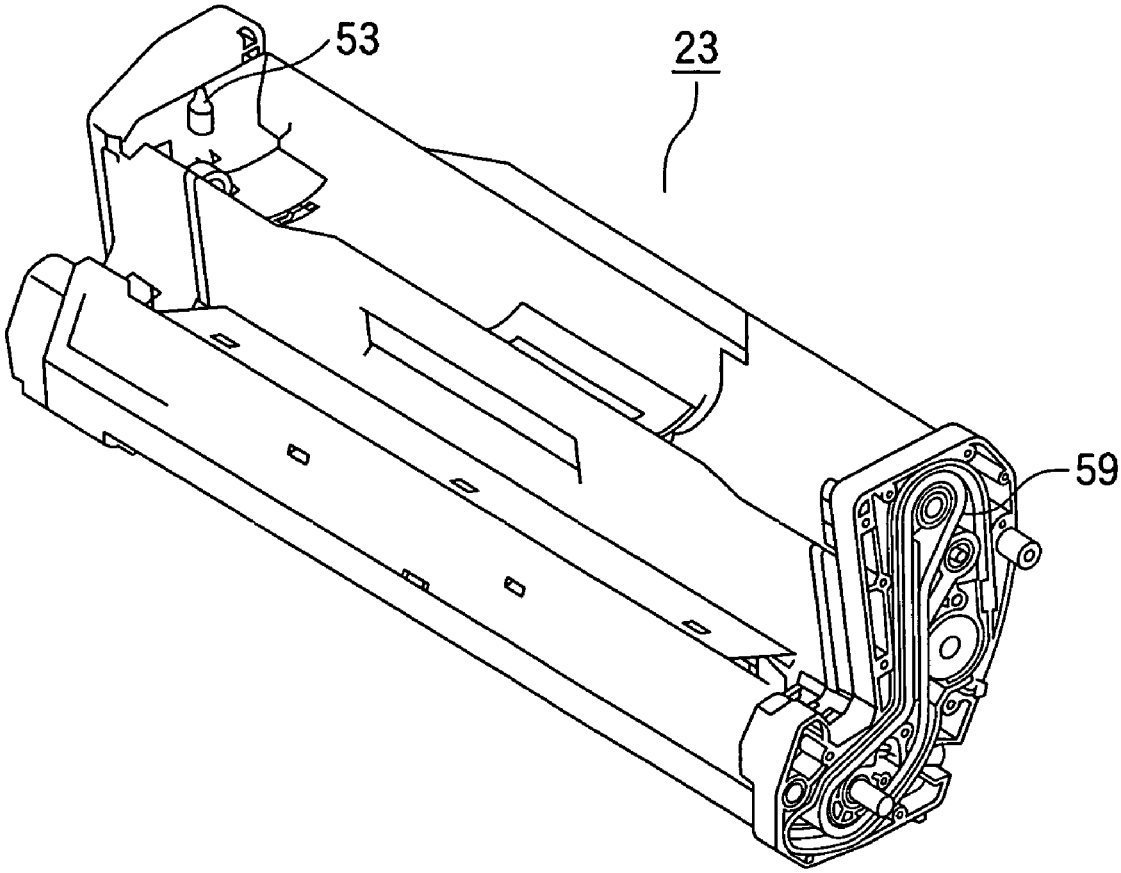
FIG. 12 is a perspective view showing the developing unit to which the toner cartridge according to the first embodiment is not mounted.

FIG. 3A is a side view showing a toner cartridge 5 according to the first embodiment. FIG. 3B is a sectional view of the toner cartridge 5 taken along a line 3B-3B in FIG. 3A. FIG. 3C shows an agitating member taken out of the toner cartridge 5 shown in FIGS. 3A and 3B. FIG. 4 is a sectional view showing a waste toner receiving portion of the toner cartridge 5 shown in FIGS. 3A and 3B. FIG. 5 and FIG. 6 are perspective views of the toner cartridge 5, respectively as obliquely seen from below and as obliquely seen from above. FIG. 7 is a perspective view of the toner cartridge 5 as obliquely seen from above but from different angle. FIGS. 8 and 9 are perspective views showing the developing unit 23 to which the toner cartridge 5 is mounted, as obliquely seen from above. FIGS. 10, 11 and 12 are perspective views showing the developing unit 23 to which the toner cartridge 5 is not mounted, as obliquely seen from above.

As shown in FIGS. 3A and 3B, the toner cartridge (i.e., the developer cartridge) 5 has a shape elongated in one direction. Along the longitudinal direction of the toner cartridge 5, the toner cartridge 5 includes a toner storing portion 31 for storing unused toner, a waste toner storing portion 32 for storing waste toner and a gear box 27 disposed between both storing portions 31 and 32.

A toner supply opening 41 (FIG. 5) is formed on the bottom of the toner storing portion 31 for supplying the unused toner to the developing unit 23. In order to open and close the toner supply opening 41 (i.e., an opening), a cylindrical shutter 33 is provided inside the toner storing portion 31.

An agitating member 35 for agitating the toner is provided in the toner storing portion 31. The agitating member 35 has a rotation shaft 35*a* parallel to the longitudinal direction of the toner cartridge 5. As shown in FIG. 3C, the agitating member 35 has a mounting portion 35*b* formed integrally with the rotation shaft (the main shaft) 35*a* and a sheet member 35*c* such as PET film or the like mounted to the mounting portion 35*b*. The agitating member 35 scrapes off the toner from an inner surface 36 of the toner storing portion 31 using the sheet member 35*c* and conveys the toner to the toner supply opening 41. In order to direct the agitated toner to the toner supply opening 41, the mounting portion 35*b* and the sheet member 35*c* have angles at a predetermined area in the longitudinal direction. A gear 34 (FIG. 3B) is provided on the rotation shaft 35*a* for transmitting the driving force from the developing unit 23 side to the agitating member 35.

The waste toner storing portion 32 includes a waste toner receiving portion 42 as a substantially cylindrical hollow portion into which a toner ejecting portion 49 (described later) of the developing unit 23 is inserted, and a waste toner conveying spiral 38 that conveys the waste toner received via the waste toner receiving portion 42. An opening-and-closing member 43 is rotatably provided inside the waste toner receiving portion 42. The opening-and-closing member 43 is cylindrical shaped, and has a waste toner recovery opening 43*a*. In a state shown in FIG. 3B, the waste toner recovery opening 43*a* faces the circumferential wall of the waste toner receiving portion 42, and is closed. When the opening-and-closing member 43 rotates at almost 90 degrees, the waste toner recovery opening 43*a* reaches the opening position as shown in FIG. 4. In this state, the waste toner ejected by the developing unit 23 is introduced into the waste toner storing portion 32.

A gear train 29 is provided in the gear box 27. The gear train 29 includes gears 29*a* and 29*b* rotated by the rotation of the agitating member 35 in the toner storing portion 31. The gears 29*a* and 29*b* transfer the rotation of the agitating member 35 to the waste toner conveying spiral 38 in the waste toner storing portion 32.

Next, the relationship between the developing unit 23 and the toner cartridge 5 will be described.

As shown in FIG. 10, the upper part of the developing unit 23 is opened so that the toner cartridge 5 can be mounted to the developing unit 23. The developing unit 23 has a wall portion 23*a* of substantially semi-cylindrical shape. An opening 23*b* corresponding to the toner supply opening 41 of the toner cartridge 5 is formed on the wall portion 23*a*.

A not shown conveying mechanism is provided in the developing unit 23 (for example, below the cleaning blade 9 shown in FIG. 2). The conveying mechanism conveys the waste toner to the side end portion of the developing unit 23. A caterpillar belt 59 (FIG. 12) for conveying the waste toner upward is provided on the side end portion of the developing unit 23. Further, a waste toner ejecting portion 49 (FIG. 10) is provided on the side end portion of the developing unit 23. The waste toner ejecting portion 49 introduces the waste toner (having been conveyed by the caterpillar belt 59) into the toner cartridge 5 so that the waste toner is stored in the toner cartridge 5.

A positioning post 47 (FIG. 10) is formed on the side end portion of the developing unit 23 on the same side as the waste toner ejecting portion 49 of the developing unit 23. The positioning post 47 engages a positioning hole 48 (FIG. 6) formed on the end surface of the toner cartridge 5 on the waste toner storing portion 32 side.

As shown in FIG. 12, a retaining post 53 is formed on the side end portion of the developing unit 23 opposite to the waste toner ejecting portion 49. The retaining post 53 engages a groove portion 52 (FIG. 7) formed on the lower side of the operation lever 51 of the toner cartridge 5. Further, an arcuate-shaped holding portion 52*a* (FIG. 7) is formed adjacent to the groove portion 52 of the toner cartridge 5. The holding portion 52*a* engages the retaining post 53 inserted through the groove portion 52.

Next, the shutter 33 and a seal member according to the first embodiment will be described.

FIG. 13 is a perspective view showing the shutter 33 taken out of the toner storing portion 31. FIG. 14 is a front view showing the outer shape of the shutter 33. As shown in FIG. 13, both of the shutter 33 and the toner storing portion 31 have substantially cylindrical shapes. The shutter 33 is inserted through a circular opening 39 formed on the side end portion of the toner storing portion 31, and is supported therein so that the shutter 33 is rotatable along the inner circumferential surface 36 (having substantially cylindrical shape) of the toner storing portion 31.

The center portion of the shutter 33 has substantially semi-cylindrical shape. An opening 33*b* is formed on a part of the center portion of the shutter 33. The opening 33*b* has substantially the same shape as the above described toner supply opening 41. Both ends of the shutter 33 have ring-like (i.e., cylindrical) shapes, and one end (on the near side in FIG. 13) of the shutter 33 protrudes out of the toner storing portion 31. A rotatable operation lever 51 is formed on the outer end (i.e., the protruding end) of the shutter 33. The rotatable operation lever 51 is operated when the toner cartridge 5 is to be mounted on the developing unit 23.

The shutter 33 has a cylindrical portion 33*a* located inside the rotatable operation lever 51 in the longitudinal direction of the shutter 33. A seal member 50 is wound around the outer circumferential surface of the cylindrical portion 33*a*. The seal member 50 seals between the outer circumferential surface of the shutter 33 and the inner circumferential surface 36 of the toner storing portion 31.

The seal member 50 is a band-shaped (strip-shaped) member composed of a sponge formed of polyurethane or poly ethylene. For example, the seal member 50 can be composed of sheet-like urethane foam "PORON" (trademark) manufactured by INOAC corporation. The backside of the seal member 50 adheres to the outer circumferential surface of the shutter 33 using an adhesive material such as double-sided adhesive tape.

Figure 15A:
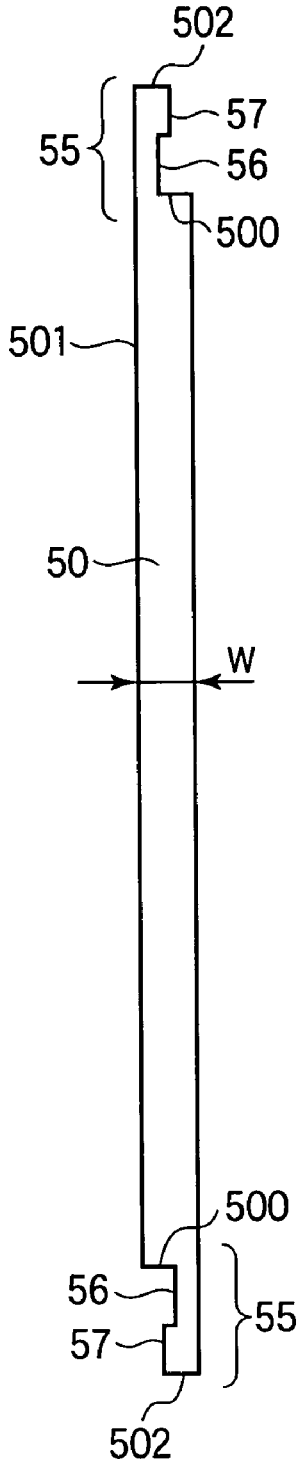
FIG. 15A is a plan view showing an entire shape of a seal member according to the first embodiment.
Figure 15B:
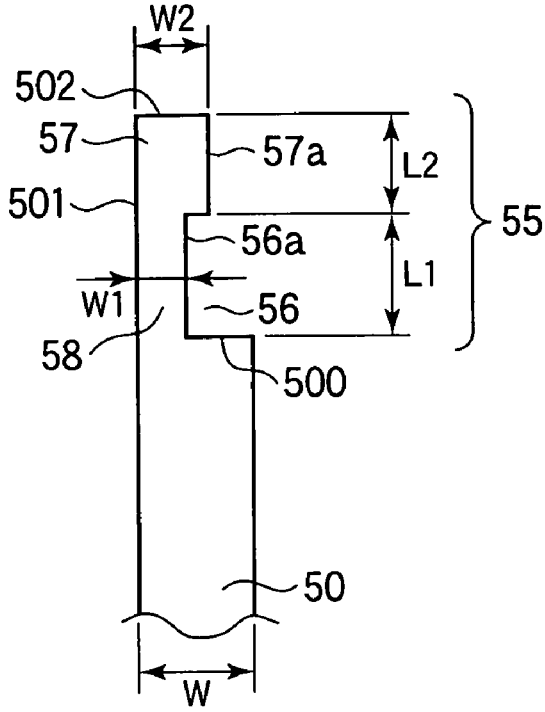
FIG. 15B is a plan view showing a shape of an end portion of the seal member.

FIG. 15A is a plan view showing an entire shape of a seal member 50. FIG. 15B is a plan view showing an end portion of the seal member. As shown in FIG. 15A, the seal member 50 has end portions 55 in the longitudinal direction. The rest of the seal member 50 becomes the main part of the seal member 50. The end portions 55 have widths narrower than the other portion of the seal member 50 having a constant width W. Each end portion 55 has a tip end and a root end 58 connected to the main part. Each end portion 55 has at the root end 58 a base end edge 500 (i.e., a terminating end edge of the portion having the constant width W) which is perpendicular to the longitudinal direction of the seal member 50.

As shown in FIG. 15B, each end portion 55 of the seal member 50 has a concave portion 56 and a convex portion 57 on an opposite side to a side end edge 501 forming an end (i.e., a long edge) of the seal member 50 in the width direction. The concave portion 56 and the convex portion 57 are arranged in order of distance from the base end edge 500. An end edge of the concave portion 56 opposite to the side end edge 501 is referred to as a concave-bottom end edge 56*a*. An end edge of the convex portion 57 opposite to the side end edge 501 is referred to as a convex-top end edge 57*a*. Each end portion 55 of the seal member 50 has at the tip end a tip edge 502 extending parallel to the base end edge 500. The width W1 of the root end 58 of the end portion 55 where the concave portion 56 is formed, the width W2 of the convex portion 57 (i.e. the width of the tip end) and the width W of other portion of the seal member 50 (i.e., the main part of the seal member 50) satisfy the relationship: W1<W2<W.

Further, in the longitudinal direction of the seal member 50, the dimension L1 of the concave portion 56 and the dimension L2 of the convex portion 57 (i.e., a distance from the tip end edge 502 to the concave portion 56) satisfy the relationship: L1>L2.

Figure 15C:
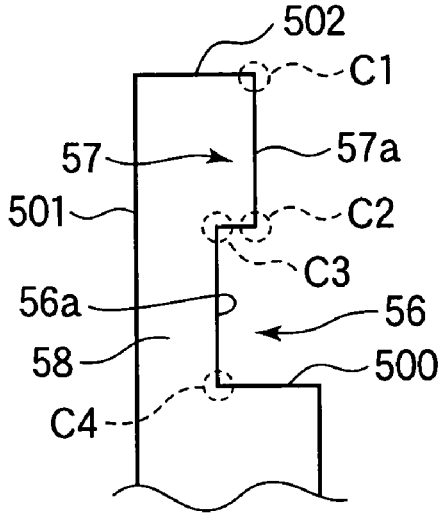
FIG. 15C is an enlarged view showing the end portion shown in FIG. 15B.

FIG. 15C is an enlarged view schematically showing the end portion 55 of the seal member 50. Angled portions C1 and C2 are formed on both ends of the convex-top end edge 57*a* of the convex portion 57. Angled portions C3 and C4 are formed on both ends of the concave-bottom end edge 56*a* of the concave portion 56. The angled portions C1, C2, C3 and C4 are right-angled corners (90°) in this example. However, the angled portions C1, C2, C3 and C4 are not limited to right-angled corners.

The end portion 55 (FIG. 15B) and the other end portion 55 of the seal member 50 have symmetrical shapes with respect to a center point in the longitudinal direction and in the width direction of the seal member 50.

Figure 16A:
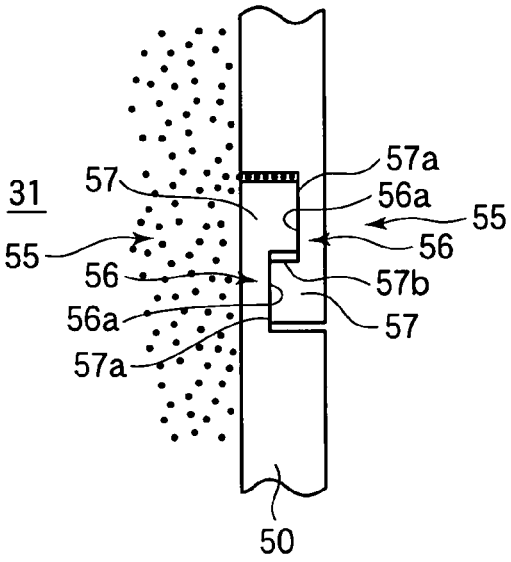
FIG. 16A is a schematic view showing a portion where both end portions of the seal member according to the first embodiment meet each other in the case where no gap is formed therebetween.
Figure 16B:
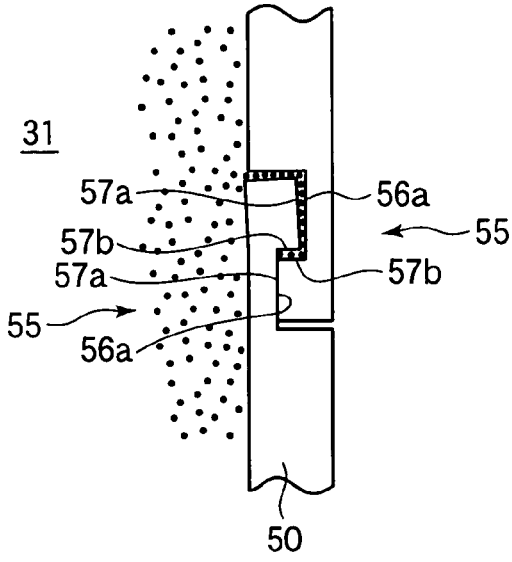
FIG. 16B is a schematic view showing the portion where both end portions of the seal member according to the first embodiment meet each other in the case where a gap is formed therebetween.

FIGS. 16A and 16B are schematic views showing a state where both end portions 55 of the seal member 50 (wound around the shutter 33) meet each other. When both end portions 55 of the seal member 50 meet each other, the convex portion 57 of one end portion 55 engages the concave portion 56 of the other end portion 55, and the concave portion 56 of one end portion 55 engages the convex portion 57 of the other end portion 55. In this state, the length L1 (in the longitudinal direction) of the concave portion 56 of the seal member 50 is longer than the length L2 of the convex portion 57 (i.e., L1>L2 in FIG. 15B), and therefore slight gaps are left in the longitudinal direction of the seal member 50.

Next, a mounting operation for mounting the toner cartridge 5 to the developing unit 23 will be described.

Figure 17:
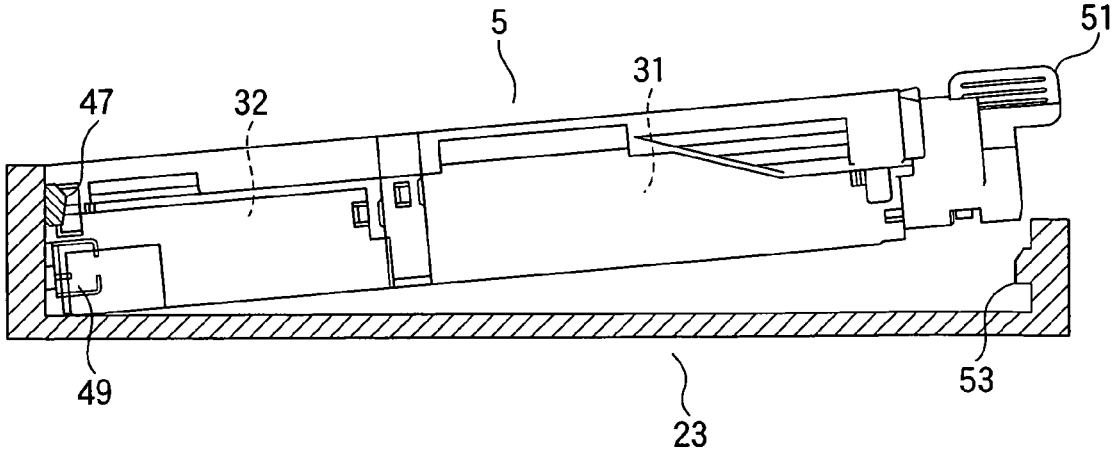
FIG. 17 is a front view showing a mounting operation for mounting the toner cartridge according to the first embodiment to the developing unit.

FIG. 17 is a front view for illustrating the mounting operation for mounting the toner cartridge 5 to the developing unit 23. The toner cartridge 5 is mounted to the developing unit 23 in a state where the toner cartridge 5 is inclined as shown in FIG. 17 so that the end portion of the toner cartridge 5 on the waste toner storing portion 32 side is directed to the end portion of the developing unit 23 on the waste toner ejecting portion 49 side. When the toner cartridge 5 is mounted to the developing unit 23, the positioning post 47 of the developing unit 23 engages the positioning hole 48 (FIG. 6) of the toner cartridge 5 so as to determine the position of the toner cartridge 5 in the developing unit 23 in the longitudinal direction.

Further, as the toner cartridge 5 is mounted to the developing unit 23, the retaining post 53 of the developing unit 23 is inserted into the groove portion 52 (FIG. 7) provided on the lower part of the operation lever 51. In this state, when the user rotates the operation lever 51 of the toner cartridge 5, the retaining post 53 engages the holding portion 52*a* adjacent to the groove portion 52 so as to restrict the movement of the toner cartridge 5 in the vertical direction. In other words, the toner cartridge 5 is locked with respect to the developing unit 23 so that the toner cartridge 5 is not dropped out of the developing unit 23.

The shutter 33 is rotated by the rotation of the operation lever 51, and the opening 33*b* (FIG. 13) of the shutter 33 is overlapped with the toner supply opening 41 (FIG. 5) of the developing unit 23. With this, the toner supply opening 41 is opened, and the toner in the toner storing portion 31 of the toner cartridge 5 can be supplied to the developing unit 23.

By mounting the toner cartridge 5 to the developing unit 23, the gear 34 (FIG. 5) exposed to the lower side of the operation lever 51 of the toner cartridge 5 engages a transmission gear 23*c* (FIG. 11) of the developing unit 23. In this state, the driving force of the developing roller 6 or the like in the developing unit 23 can be transmitted to the agitating member 35 or the like in the toner cartridge 5.

Next, the operation of the image forming apparatus will be described with reference to FIG. 1.

The recording medium stored in the feed cassette 21 is individually fed out of the feed cassette 21 by the pickup roller 21, and is fed by the feed roller pairs 16 and 17 along the feeding path 15A. In this state, the thickness of the recording medium is detected by a thickness detecting portion 26 provided on the upstream side of the feed roller pair 17 (disposed on the downstream side of the feed roller pair 16). Further, the recording medium is conveyed by the transfer belt 11 of the transfer belt unit 24, and toner images of the respective colors (formed by the respective image forming units 20*a*, 20*b*, 20*c* and 20*d*) are transferred to the recording medium by the transfer rollers 12.

The recording medium to which the toner image has been transferred is conveyed by the conveying roller pairs 18 and 19, and is ejected to the stacker portion 30A.

Next, the operation of the image forming unit 20 including the developing unit 23 will be described with reference to FIG. 2.

The unused toner T stored in the toner storing portion 31 (FIG. 3) of the toner cartridge 5 is supplied to the developing unit 23 via the toner supply opening 41 (FIG. 5). In the developing unit 23, the toner is conveyed by the toner supply roller 8 and adheres to the surface of the developing roller 6. The thickness of the toner on the surface of the developing roller 6 is regulated by the developing blade 7, and the toner layer having uniform thickness is formed. The toner layer on the surface of the developing roller 6 adheres to the latent image (formed by the exposing unit 3) on the photosensitive body 1, and the latent image is developed. The toner image is transferred to the recording medium (indicated by numeral 13 in FIG. 2) by means of transfer bias of the transfer roller 12 and the transfer belt 11. The residual toner remaining on the surface of the photosensitive body 1 (without being transferred to the recording medium 13) is scraped off from the surface of the photosensitive body 1 by the cleaning blade 9, and becomes waste toner. The waste toner is conveyed by the caterpillar belt 59 (FIG. 12) to the toner ejecting portion 49 (FIG. 10), and is stored in the waste toner storing portion 32 (FIG. 3) of the toner cartridge 5 via the waste toner receiving portion 42.

Further, when the developing roller 6 or the like in the developing unit 23 is driven to rotate, the rotational driving force is transmitted to the toner cartridge 5 via the transmission gear 23*c* (FIG. 11) and the gear 34 (FIG. 5), and the agitating member 35 in the toner storing portion 31 is driven to rotate. By the rotation of the agitating member 35, the seat member 35*c* (mounted to the agitating member 35 at a predetermined angle) conveys the toner toward the toner supply opening 41 while scraping off the toner adhering to the inner wall 36 of the toner storing portion 31. With this, the toner in the toner storing portion 31 is supplied to the developing unit 23 via the toner supply opening 41 (FIG. 5).

When the agitating member 35 in the toner storing portion 31 rotates, the driving force is transmitted to the waste toner conveying spiral 38 via the gear train 29 connected to the agitating member 35. By the rotation of the waste toner conveying spiral 38, the waste toner (introduced into the waste toner storing portion 32 via the waste toner recovery opening 43*a* of the waste toner receiving portion 42) is conveyed to the gear box 27 side of the waste toner storing portion 32.

Next, the functions and advantages of the first embodiment will be described.

As was described with reference to FIGS. 16A and 16B, the seal member 50 is wound around the outer circumference of the shutter 33 at one revolution, and is fixed to the outer circumference of the shutter 33 so that both end portions 55 of the seal member 50 meet each other. In a state where the end portions 55 of the seal member 50 meet each other, the convex portion 57 of one end portion 55 engages the concave portion 56 of the other end portion 55, and the concave portion 56 of one end portion 55 engages the convex portion 57 of the other end portion 55.

To be more specific, both end portions 55 of the seal member 50 meet each other so that the convex-top end edge 57*a* of each convex portion 57 contacts the concave-bottom end edge 56*a* of the concave portion 56 facing the convex portion 57. In this state, the seal member 50 seals between the outer circumferential surface of the shutter 33 and the inner circumferential surface 36 of the toner storing potion 31.

Since the length L1 of the concave portion 56 is longer than the length L2 of the convex portion 57 as shown in FIG. 15B, variation of the length of the seal member 50 due to manufacturing error or due to elongation during attaching operation can be absorbed within the range of the above described difference in length (L1−L2). In other words, variation or the like of the length of the seal member 50 can be absorbed within the range of gaps between the concave portion 56 and the convex portion 57 in the longitudinal direction of the seal member 50.

Further, as shown in FIG. 16A, even when the toner in the toner storing portion 31 moves into between both end portions 55 of the seal member 50, the convex-top end edge 57*a* of the convex portion 57 and the concave-bottom end edge 56*a* of the concave portion 56 contact each other, and therefore the movement of the toner toward the outside is prevented. Further, since the angled portions C1, C2, C3 and C4 are formed between both end portions 55 as shown in FIG. 15C, the movement of the toner is prevented by the angled portions C1, C2, C3 and C4, and therefore the leakage of the toner is prevented.

Further, even when one concave portion 56 and the corresponding convex portion 57 do not engage each other (i.e., the concave-bottom end edge 56*a* and the convex top end edge 57*a* do not contact each other) as shown in FIG. 16B, the passage of the toner can be prevented as long as the other concave portion 56 and the corresponding convex portion 57 engage each other. In other words, high sealing performance can be obtained.

Furthermore, the seal member 50 is pressed between the outer circumferential surface of the shutter 33 and the inner circumferential surface 36 of the toner storing portion 31, and is compressed. Therefore, the concave portions 56 and the convex portions 57 of the end portions 55 of the seal member 50 are brought into tighter contact with each other than before the shutter 33 is attached to the toner cartridge 5.

The shutter 33 rotates while being pressed against the inner circumferential surface 36 of the toner storing portion 31 for opening and closing the toner supply opening 41. In this state, it is considered that both end portions 55 of the seal member 50 are applied with forces so that the end portions 55 separate from each other in the circumferential direction. In such a case, facing end edges 57*b* (FIGS. 16A, 16B) of the concave portions 57 of both end portions 55 of the seal member 50 tightly contact each other, and therefore the sealing performance can be further enhanced.

As described above, according to the first embodiment, the concave portion 56 and the convex portion 57 of one end portion 55 of the seal member 50 engage the convex portion 57 and the concave portion 56 of the other end portion 55, and therefore the leakage of the toner in the toner storing portion 31 can be surely prevented.

Further, the variation of the length of the seal member 50 due to manufacturing error or the like or due to elongation during the attaching operation can be absorbed within the range of the difference between lengths (L1−L2) of the concave portion 56 and the convex portion 57.

Furthermore, there are two portions where the concave portions 56 engage the convex portions 57, and therefore, even when one concave portion 56 does not engage corresponding convex portion 57, the leakage of the toner can be prevent as long as the other concave portion 56 engages the corresponding convex portion 57.

Moreover, since the concave portions 56 need to engage the convex portions 57 during the operation for attaching the seal member 50 to the shutter 33, and therefore the operator develops a conscious of causing both end portions 55 of the seal member 50 to meet each other.

Modification

Figure 18:
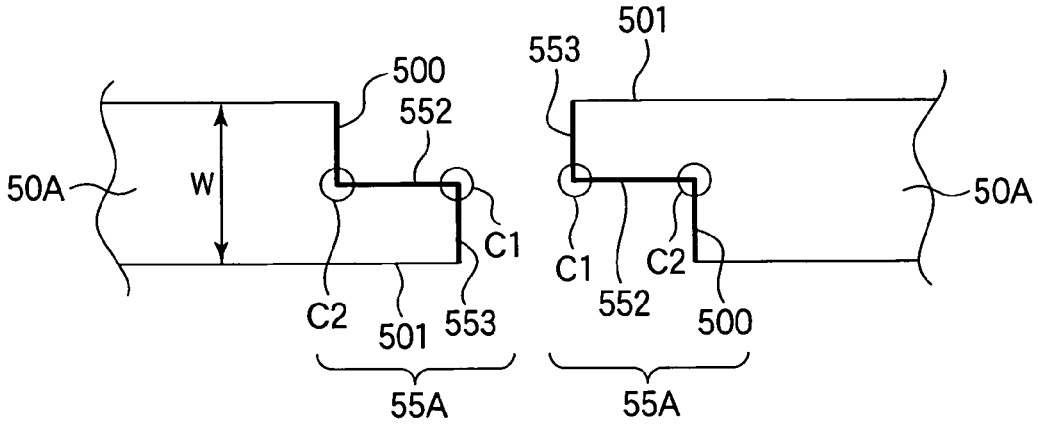
FIG. 18 is an enlarged view showing shapes of both end portions of a seal member according to a modification of the first embodiment.

FIG. 18 is an enlarged view showing both end portions of a seal member 50A according to a modification of the first embodiment. The modification shown in FIG. 18 is different from the above described first embodiment in the shape of both end portions 55A of the seal member 50.

As shown in FIG. 18, the respective end portions 55A of the seal member 50A are narrower than the other portion of the seal member 50A having a constant width W. Each end portion 55A has a base end edge 500 (i.e., a terminating end edge of the portion having the constant width W) which is perpendicular to the longitudinal direction of the seal member 50A. The width of each end portion 55A is half (½) the width W of the other portion of the seal member 50A.

Each end portion 55A is rectangular shaped, and has a side end edge 501 which is an end (a long edge) of the seal member 50A in the width direction, an opposing end edge 552 facing the side end edge 501, and a tip end edge 553 which is substantially parallel to the base end edge 500. An angled portion C1 is formed between the tip end edge 553 and the opposing end edge 552. An angled portion C2 is formed between the opposing end edge 552 and the base end edge 500. The angled portions C1 and C2 are right-angled corners in this example. However, the angled portions C1 and C2 are not limited to the right-angled corners. Further, both end portions 55A of the seal member 50A have symmetrical shapes with respect to a center point in the longitudinal direction and in the width direction of the seal member 50A.

When both end portions 55A of the seal member 50 meet each other, the opposing end edge 552 of one end portion 55A contacts the opposing end edge 552 of the other end portion 55A in the width direction of the seal member 50A. Further, the tip end edge 553 of one end portion 55A contacts the base end edge 500 of the other end portion 55A in the longitudinal direction of the seal member 50A. The base end edge 500 of one end portion 55A contacts the tip end edge 553 of the other end portion 55A in the longitudinal direction of the seal member 50A.

In this modification, even when the toner moves into between both end portions 55A of the seal member 50A, the passage of the toner is prevented by the angled portions C1 and C2, and therefore the leakage of the toner can be prevented. Further, high sealing performance can be maintained as long as at least one of the tip end edge 553, the opposing end edge 552 and the base end edge 500 of the end portion 55A engages the corresponding edge of the other end portion 55A.

COMPARATIVE EXAMPLE

Figure 19:
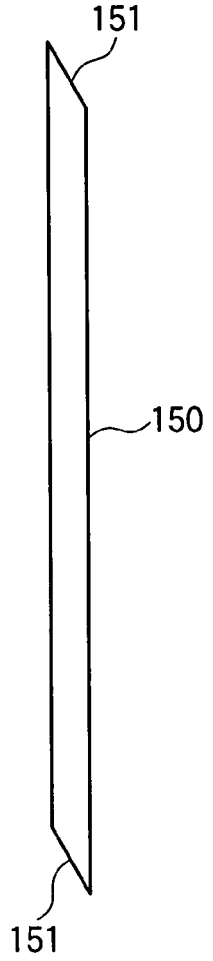
FIG. 19 is a plan view showing an entire shape of a seal member according to the comparative example.
Figure 20A:
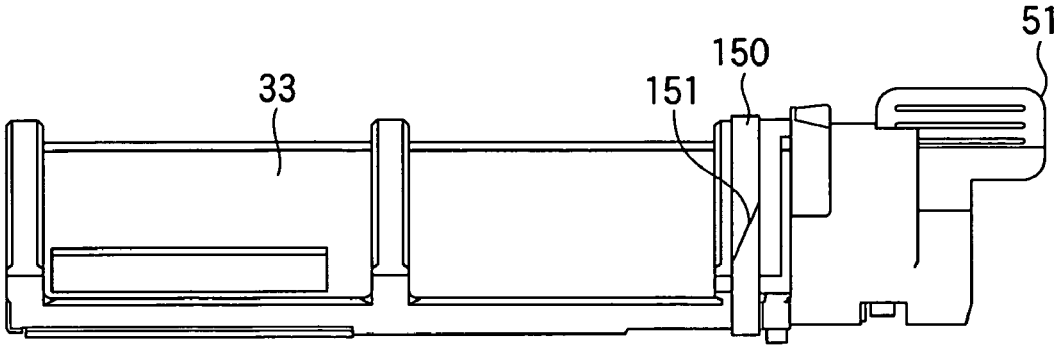
FIG. 20A is a front view showing a toner cartridge according to the modification.
Figure 20B:
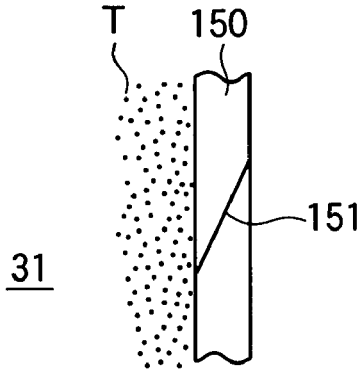
FIGS. 20B and 20C are schematic views showing a portion where both end portions of the seal member according to the modification meet each other.
Figure 20C:
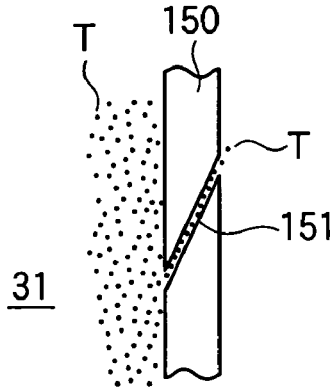

FIG. 19 shows an entire shape of a seal member according to a comparative example in comparison to the first embodiment and its modification. FIG. 20A is a front view of a shutter to which the seal member of the comparative example is attached. FIGS. 20B and 20C are schematic view showing a portion where both end portions of the seal member of the comparative example meet each other. The comparative example is explained for the purpose of facilitating understanding of the functions and advantages of the above described first embodiment and its modification, but does not constitute a part of the present invention.

In the comparative example, as shown in FIG. 19, inclined (i.e., tapered) end edges 151 are formed on both end portions of the seal member 150. Further, as shown in FIG. 20A, the seal member 150 is fixed to the outer circumferential surface of the shutter 33 so that both inclined end edges 151 contact each other.

As shown in FIG. 20B, if there is no gap between both inclined end edges 151 of the seal member 150, the leakage of the toner (indicated by mark T in FIGS. 20B and 20C) in the toner storing portion 31 to the outside can be prevented. However, as shown in FIG. 20C, if there is a gap between both inclined end edges 151 of the seal member 150 due to variation of the length of the seal member 150 or the like, the toner in the toner storing portion 31 may leak outside, i.e., a sufficient sealing performance can not be obtained.

In contrast, according to the above described first embodiment and its modification, even when there is a gap between both end portions 55 (55A) of the seal member 50 (50A), the leakage of the toner can be prevented due to the engagement between the concave portions 56 and the convex portions 57 of both end portions 55 of the seal member 50 (50A), and due to the angled portions of both end portions 55 of the seal member 50 (50A), with the result that high sealing performance can be obtained.

Second Embodiment

Figure 21B:
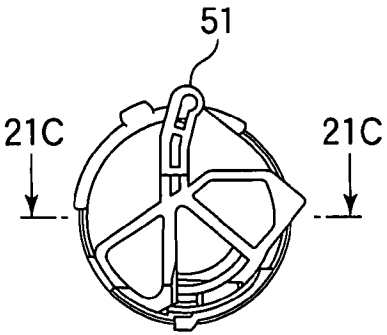
FIGS. 21A, 21B and 21C are a front view, a side view and a sectional view showing a shutter to which a seal member according to the second embodiment is attached.
Figure 21A:
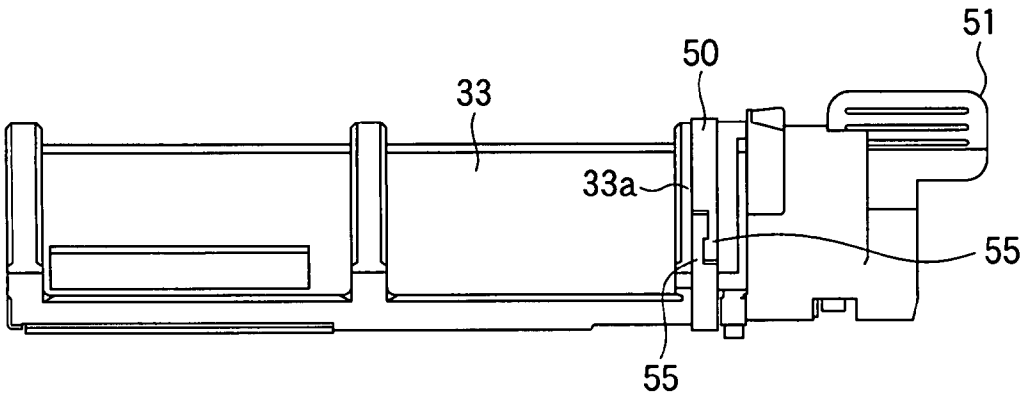
Figure 21C:
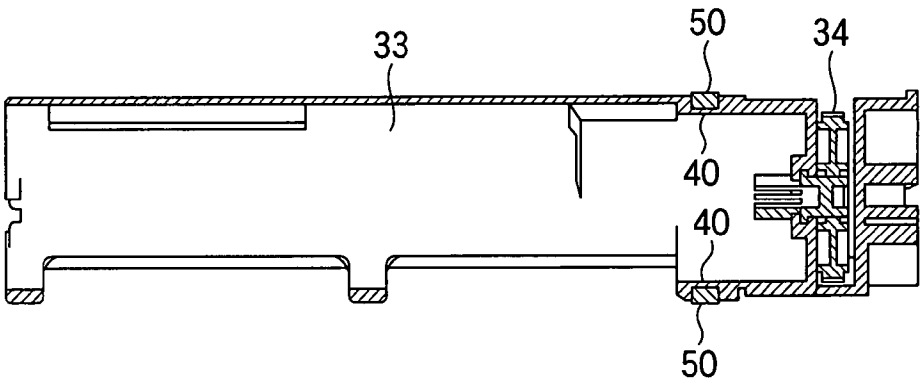
Figure 22A:
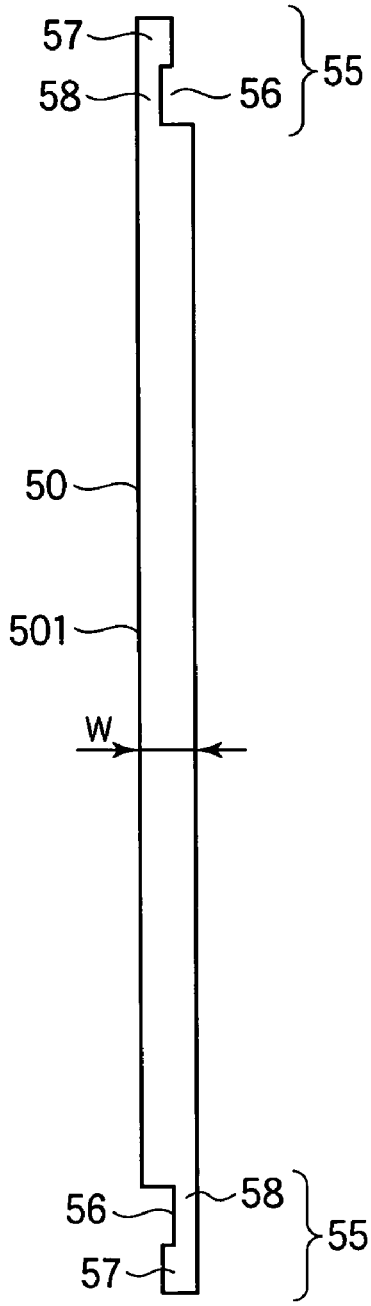
FIG. 22A is a plan view showing an entire shape of the seal member according to the second embodiment.
Figure 22B:
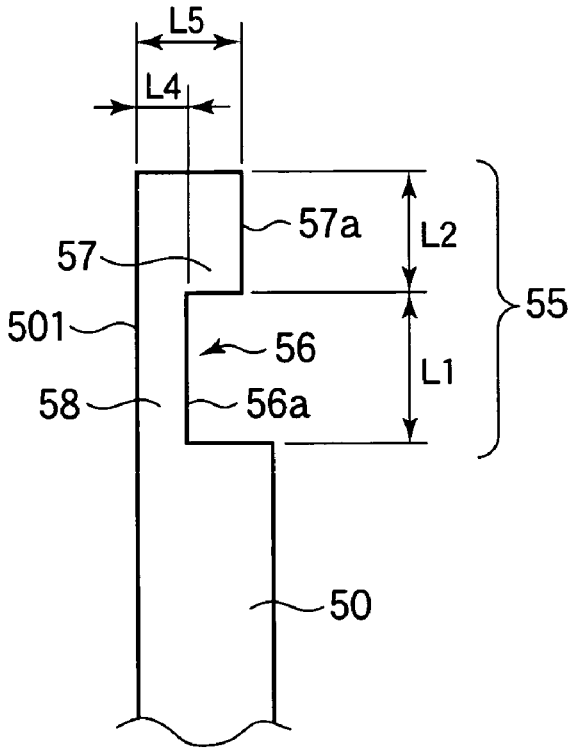
FIG. 22B is an enlarged view showing the shape of one end portion of the seal member according to the second embodiment.
Figure 23A:
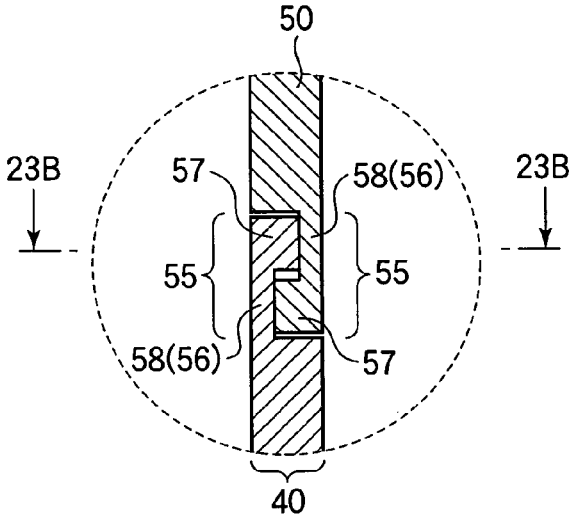
FIGS. 23A and 23B are an enlarged view and a sectional view showing a portion where both end portions of the seal member according to the second embodiment meet each other.
Figure 23B:
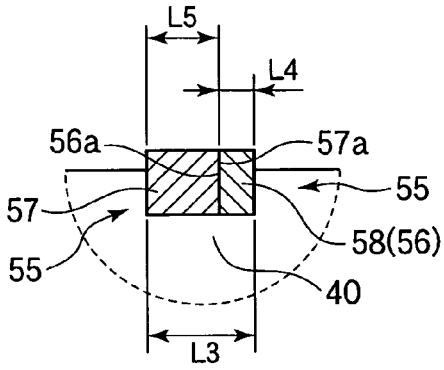

FIGS. 21A and 21B are a front view and a side view showing a shutter to which a seal member according to the second embodiment is attached. FIG. 21C is a sectional view taken along a line 21C-21C shown in FIG. 21B. FIG. 22A is a plan view showing an entire shape of the seal member according to the second embodiment. FIG. 22B is an enlarged view showing an end portion of the seal member. FIG. 23A is an enlarged view showing a portion where both end portions of the seal member meet each other. FIG. 23B is a sectional view taken along a line 23B-23B shown in FIG. 23A.

As shown in FIGS. 21A through 21C, in the second embodiment, the seal member 50 is pushed into a groove portion 40 (FIG. 21C) formed on the cylindrical portion 33*a* of the shutter 33 in the circumferential direction so that a part of the seal member 50 protrudes from the groove portion 40. As shown in FIG. 22A, each end portion 55 of the seal member 50 has the concave portion 56 and the convex portion 57, as was described in the first embodiment. As shown in FIG. 22B, the dimension L1 of the concave portion 56 and the dimension L2 of the convex portion 57 (in the longitudinal direction of the seal member 50) satisfy the relationship: L1>L2.

In the second embodiment, the width of the groove portion 40 is expressed as L3, the width of the part 58 of the seal member 50 where the concave portion 56 is formed is expressed as L4, and the width of the convex portion 57 is expressed as L5. The following relationship is satisfied:

$$L3 \leqq (L4+L5).$$

In this regard, (L4+L5) is not too larger than L3. In other words, the seal member 50 can be pushed into the groove portion 40 (having the width L3) by deforming the seal member 50.

With such an arrangement, by pushing the seal member 50 into the groove portion 40 during the attaching operation of the seal member 50, the convex-top end edge 57*a* (FIG. 23B) of the convex portion 57 never fails to contact the concave-bottom end edge 56*a* of the concave portion 56 (FIG. 23B). Therefore, even when the toner moves into between both end portions 55, the passage of the toner can be prevented due to the tight contact between the convex-top end edge 57*a* of the convex portion 57 and the concave-bottom end edge 56*a* of the concave portion 56. Therefore, the sealing performance can be further enhanced.

As described above according to the second embodiment, it is possible to ensure that the concave portions 56 and the convex portions 57 of the end portions 55 of the seal member 50 are brought into tight contact with each other by pushing the seal member 50 into the groove portion 40, and therefore the sealing performance can be further enhanced.

Further, tight contact between both end portions 55 of the seal member 50 can be obtained only by causing both end portions 55 of the seal member 50 to meet each other in the groove portion 40, and therefore the assembling operation can be facilitated.

Third Embodiment

Figure 24B:
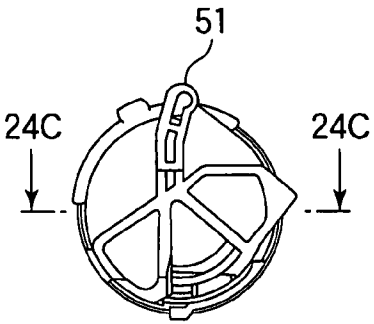
FIGS. 24A, 24B and 24C are a front view, a side view and a section view showing a shutter to which a seal member according to the third embodiment is attached.
Figure 24A:
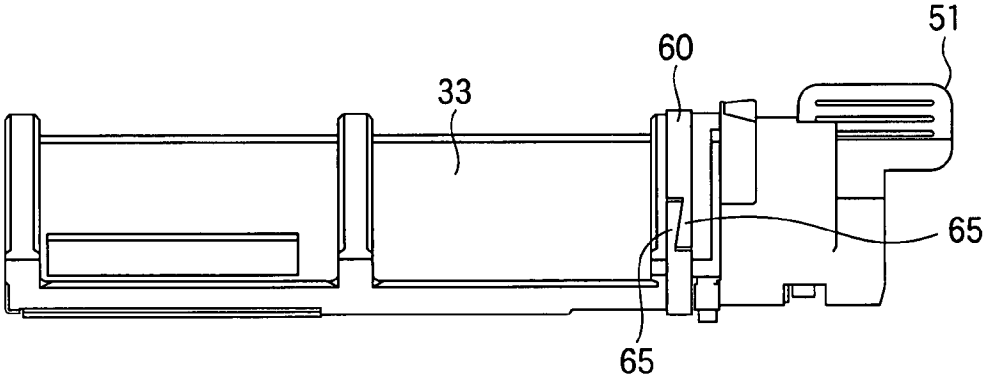
Figure 24C:
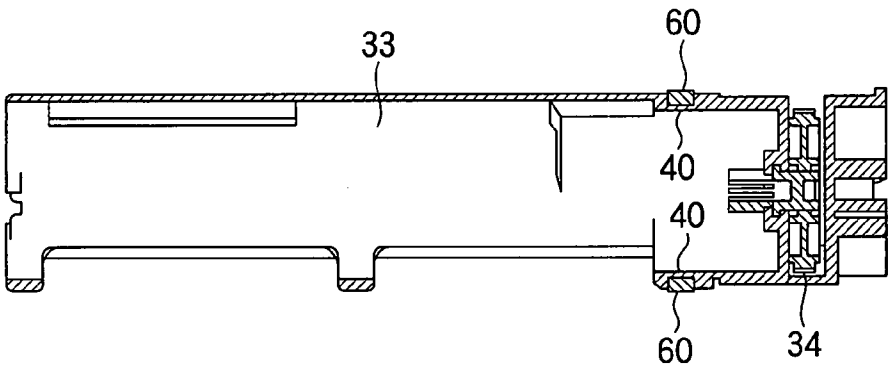
Figure 25A:
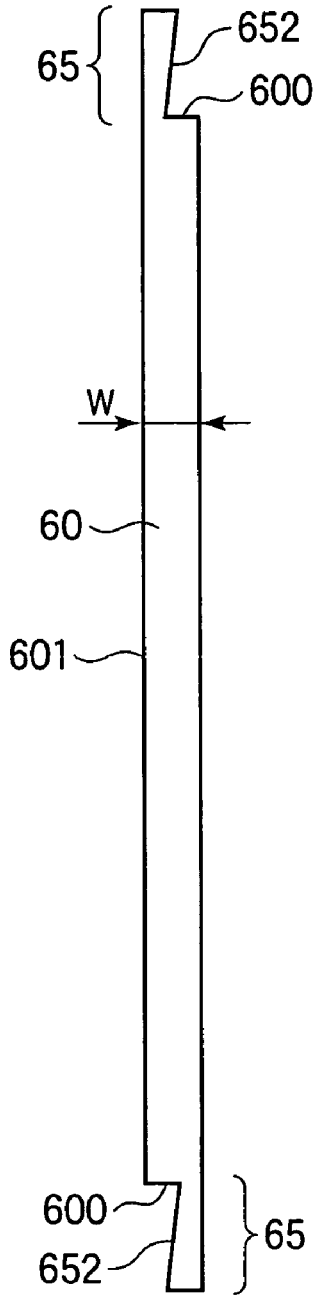
FIG. 25A is a plan view showing an entire shape of the seal member according to the third embodiment.
Figure 25B:
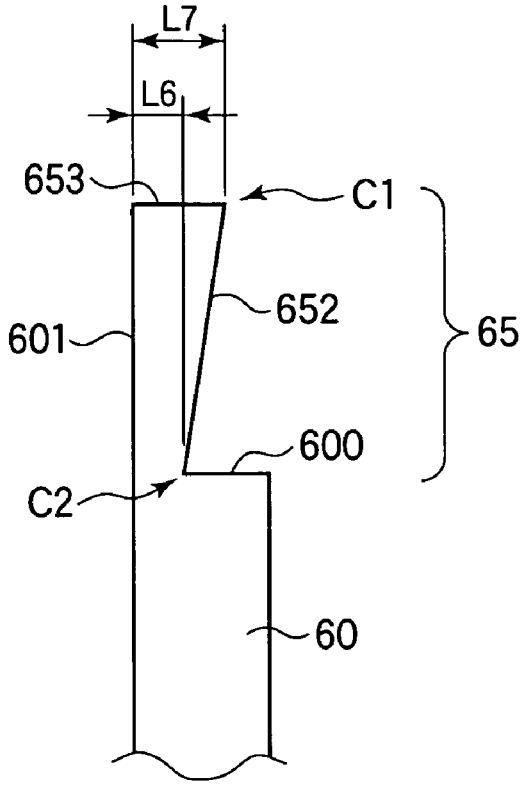
FIG. 25B is an enlarged view showing the shape of one end portion of the seal member according to the third embodiment.
Figure 26A:
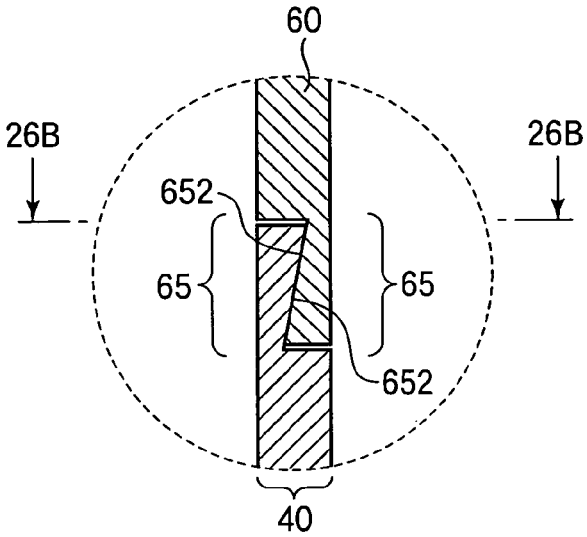
FIGS. 26A and 26B are an enlarged view and a sectional view showing a portion where both end portions of the seal member according to the third embodiment meet each other.
Figure 26B:
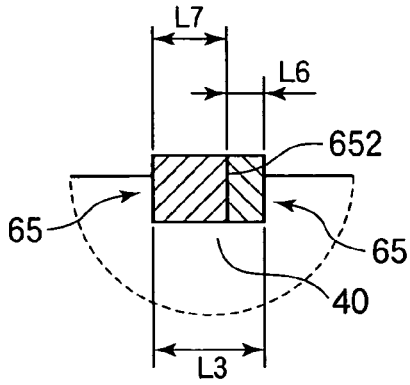

FIGS. 24A and 24B are a front view and a side view of an outer shape of the shutter to which a seal member according to the third embodiment is attached. FIG. 24C is a sectional view taken along a line 24C-24C shown in FIG. 24B. FIG. 25A is a plan view showing an entire shape of the seal member according to the third embodiment. FIG. 25B is an enlarged view showing an end portion of the seal member. FIG. 26A is an enlarged view showing a portion where both end portions of the seal member according to the third embodiment meet each other. FIG. 26B is a sectional view taken along a line 26B-26B shown in FIG. 26A.

As shown in FIGS. 24A, 24B and 24C, the seal member 60 according to the third embodiment is pushed into the groove portion 40 (FIG. 24C) provided on the shutter 33 as was described in the second embodiment.

In the third embodiment, as shown in FIG. 25A, the end portions 65 of the seal member 60 are narrower than other portion of the seal member 60 having a constant width W. Each end portion 65 has a base end edge 600 (i.e., a terminating end edge of the portion having the constant width W) which is perpendicular to the longitudinal direction of the seal member 60.

As shown in FIG. 25B, each end portion 65 of the seal member 60 is substantially trapezoidally-shaped, and has a side end edge 601 which is an end (i.e., a long edge) of the seal member 60 in the width direction, an inclined end edge 652 opposing the side end edge 601, and a tip end edge 653 which is substantially parallel to the base end edge 600. The inclined end edge 652 is inclined so that the width of each end portion 65 increases toward the tip (i.e., the tip end edge 653). An acute-angled portion C1 is formed between the inclined end edge 652 and the tip end edge 653. An acute-angled portion C2 is formed between the inclined end edge 652 and the base end edge 600. Both end portions 65 of the seal member 60 have symmetrical shapes with respect to a center point in the longitudinal direction and in the width direction of the seal member 60. When both end portions 65 of the seal member 60 meet each other, both inclined end edges 653 of the end portions 65 contact each other.

Further, as shown in FIGS. 26A and 26B, the width L3 of the groove portion 40, the width L7 of the tip (i.e., the length of the tip end edge 653) of each end portion 65 and the width L6 of the root end of each end portion 65 satisfy the following relationships:

$$L6<L7,$$

$$L3 \leqq (L6+L7).$$

In this regard, (L6+L7) is not too larger than L3, as was described in the second embodiment. In other words, the seal member 60 can be pushed into the groove portion 40 (having the width L3) by deforming the seal member 60.

With such a relationship, even when the width of the seal member 60 is narrower than a designed width due to manufacturing error, it is possible to bring the inclined end edges 652 of both end portions 65 into tight contact with each other, by pushing the seal member 60 into the groove portion 40. Further, even when the attaching position of the seal member 60 varies due to elongation of the seal member 60 during the attaching operation, it is possible to bring the inclined end edges 652 of both end portions 65 into tight contact with each other.

Figure 27A:
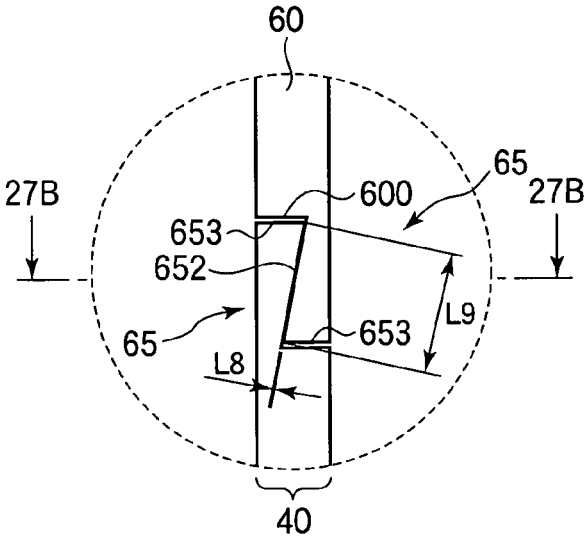
FIGS. 27A and 27B are an enlarged view and a sectional view showing a portion where both end portions of the seal member according to the third embodiment meet each other in the case where there is a slight displacement.
Figure 27B:
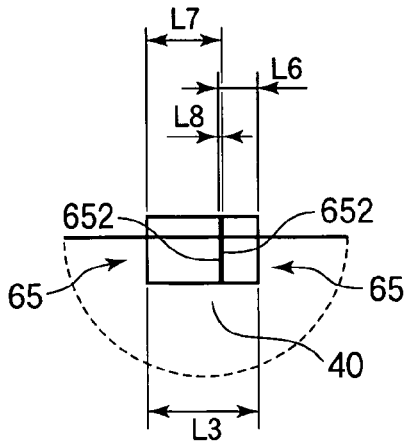
Figure 28A:
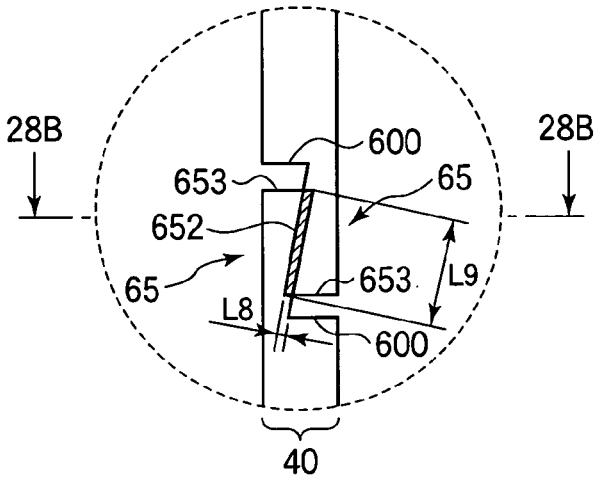
FIGS. 28A and 28B are an enlarged view and a sectional view showing a portion where both end portions of the seal member according to the third embodiment meet each other in the case where there is a large displacement.
Figure 28B:
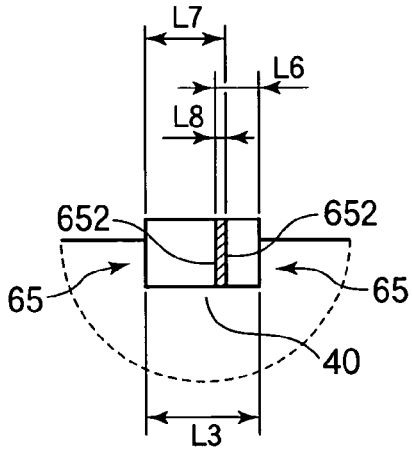

FIG. 27A is an enlarged view showing a portion where both end portions of the seal member 60 meet each other when there is a slight displacement of the attaching position of the seal member 60 in the longitudinal direction thereof. FIG. 27B is a sectional view taken along a line 27B-27B shown in FIG. 27A. FIG. 28A is an enlarged view showing a portion where both end portions of the seal member 60 meet each other when there is a large displacement of the attaching position of the seal member 60 in the longitudinal direction thereof. FIG. 28B is a sectional view taken along a line 28B-28B shown in FIG. 28A.

Comparing FIGS. 27A and 27B with FIGS. 28A and 28B, it is understood that, as the gap between the end portions 65 of the seal member 60 in the longitudinal direction thereof increases, the inclined end edges 652 tightly contact each other in a state where the end portions 65 are compressed in the width direction. Therefore, even if the contact length L9 (i.e., the length with which the inclined end edges 652 contact each other) is short, the inclined end edges 652 surely and tightly contact each other due to the increase in compression amount of portions of the inclined end edges 652 (indicated by mark L8). Therefore, the sealing effect can be enhanced.

When the shutter 33 is mounted to the toner storing portion 31, the seal member 60 is pressed between the outer circumferential surface of the shutter 33 and the inner circumferential surface 36 of the toner storing portion 31 (as was described in the first and second embodiments), and is compressed, with the result that both inclined end edges 652 further tightly contact each other than before the shutter 33 is mounted to the toner storing portion 31.

Further, the shutter 33 rotates while being pressed against the inner circumferential surface 36 of the toner storing portion 31 for opening and closing the toner supply opening 41. In this state, it is considered that both end portions 65 of the seal member 60 are applied with forces so that the end portions 65 separate from each other in the circumferential (i.e., rotational) direction. In this regard, since each end portion 65 of the seal member 60 has a shape such that the width increases toward the tip end, the inclined end edges 652 further tightly contact each other as the end portions 65 shift apart from each other. Therefore, the sealing performance can be further enhanced.

As described above, according to the third embodiment, no gap is formed between both end portions 65 of the seal member 60 even when there is a variation of dimensions due to manufacturing error, a displacement of the attaching position of the seal member 60, or the like. As a result, the leakage of the toner can be surely prevented. To be more specific, even when the contact length L9 with which the inclined end edges 652 contact each other is short, the inclined end edges 652 tightly contact each other due to the increase in compression amount of the seal member 60 in the width direction. Therefore, the sealing effect can be enhanced.

Further, the displacement of the attaching position of the seal member can be allowed to some extent, and therefore yield rate can be enhanced.

In the above described second embodiment, it is necessary that the concave portion 56 and the convex portion 57 of one end portion 55 engage the convex portion 57 and the concave portion 56 of the other end portion 55. However, in the third embodiment, it is only necessary to bring the inclined end edges 652 into contact with each other (i.e., only one contact portion is required), and therefore the assembling operation can be further simplified.

In this embodiment, an example in which the seal member 60 is pushed into the groove portion 40 of the shutter 33 is described. However, the shutter 30 can be attached to the outer circumferential surface of the shutter 33 except the groove portion 40 (for example, using adhesion).

Modifications

Figure 29A:
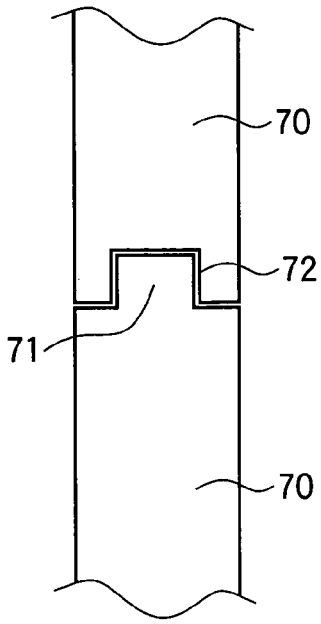
FIGS. 29A and 29B are enlarged views showing modifications of the embodiments.
Figure 29B:
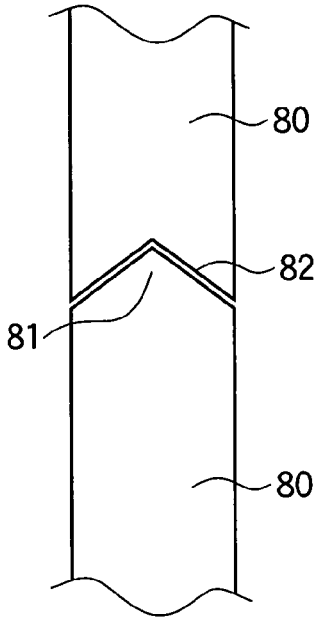

FIGS. 29A and 29B show modifications of the above described embodiments.

In a modification shown in FIG. 29A, one end portion of a seal member 70 has a rectangular convex portion 71 formed at the center portion in the width direction. The other end portion of the seal member 70 has a rectangular concave portion 72 formed at the center portion in the width direction. In this case, when the seal member 70 is attached to the outer circumferential surface of the shutter 33, the convex portion 71 of one end portion of the seal member 70 engages the concave portion 72 of the other end portion of the seal member 70. Therefore, even when the toner moves into between both end portions of the seal member 70, angled portions (for example, right-angled corners) of the convex portion 71 and the concave portion 72 prevent the passage of the toner, with the result that the leakage of the toner to the outside can be prevented.

In another modification shown in FIG. 29B, one end portion of a seal member 80 has a triangular convex portion 81, and the other end portion of the seal member 80 has a triangular concave portion 82. In this case, when the seal member 80 is attached to the outer circumferential surface of the shutter 33, the convex portion 81 of one end portion of the seal member 80 engages the concave portion 82 of the other end portion of the seal member 80. Therefore, even when the toner moves into between both end portions of the seal member 80, angled portions (i.e., apexes) of the convex portion 81 and the concave portion 82 prevent the passage of the toner, with the result that the leakage of the toner to the outside can be prevented.

In the above described embodiments and modifications, examples where the seal member is attached to the shutter 33 of the toner storing portion 31 has been described. However, the present invention is not limited to such examples. For example, the same advantage can be obtained by sealing a gap formed between two cylindrical members provided overlapping with each other by using the above described configurations. For example, the present invention is applicable to a configuration for sealing a gap around a shutter (an opening-and-closing member) for opening and closing an opening of a waste toner storing portion (i.e., an opening for receiving waste toner).

The present invention is applicable to a printer, a facsimile machine, a copier and an apparatus having these functions.

While the preferred embodiments of the present invention have been illustrated in detail, it should be apparent that modifications and improvements may be made to the invention without departing from the spirit and scope of the invention as described in the following claims.

What is claimed is:

1. A developer cartridge comprising:

a storing portion that stores developer and has an opening;

a shutter member that opens and closes said opening, the shutter member having a groove; and a seal member that is wrapped in the groove and seals between said shutter member and said storing portion, said seal member having an elongated shape, and including two end portions and a main part formed therebetween in a longitudinal direction thereof, the end potions facing each other, each end portion having a tip end, and a root end connected to said main part, said tip end and said root end being adjacent to each other in the longitudinal direction, a width of said tip end being smaller than a width of said main part and larger than a width of said root end, a sum of the width of said tip end and the width of said root end is not smaller than a width of said groove.

2. The developer cartridge according to claim 1, wherein each end portion of said seal member has a concave portion on one side of said seal member in a width direction of said seal member, said concave portion being disposed on said root end side of said end portion, and at least one angled portion is provided on said concave portion.

3. The developer cartridge according to claim 1, wherein, in the longitudinal direction of said seal member, a length L1 of said concave portion of said end portion and a distance L2 from a tip end edge of said end portion to said concave portion satisfy the relationship: L1>L2.

4. A developer cartridge, comprising:

a storing portion that stores developer and has an opening;

a shutter member that opens and closes said opening; and a seal member that seals between said shutter member and said storing portion, said seal member having an elongated shape, and including two end portions and a main part formed therebetween in a longitudinal direction thereof, the end potions facing each other, each end portion having a tip end, and a root end connected to said main part, said tip end and said root end being adjacent to each other in the longitudinal direction, a width of said tip end being smaller than a width of said main part and larger than a width of said root end, wherein each end portion of said seal member has an inclined end edge which is inclined with respect to said longitudinal direction of said seal member.

5. The developer cartridge according to claim 4, wherein said inclined end edge extends from said root end to said tip end, and has an inclination such that said width of said tip end is larger than said width of said root end.

6. The developer cartridge according to claim 4, wherein said shutter member has a groove for winding said seal member, and in a width direction of said seal member, a width L3 of said groove, a width L6 of said end portion at a root end thereof, and a width L7 of said end portion at a tip end thereof satisfy the relationship:

$$L3 \leqq (L6+L7).$$

7. The developer cartridge according to claim 1, wherein said seal member is a band-shaped member.

8. The developer cartridge according to claim 1, wherein said opening is an opening through which said developer stored in said storing portion is taken outside.

9. The developer cartridge according to claim 1, wherein said shutter member opens and closes said opening from inside of said storing portion, and said seal member is provided on an outer circumferential surface of said shutter member so as to seal between said outer circumferential surface of said shutter member and an inner circumferential surface of said storing portion.

10. A developing device using said developer cartridge according to claim 1.

11. An image forming apparatus including said developing device according to claim 10.

12. The developer cartridge of claim 1, wherein a side edge of one end portion of said seal member faces a side edge of the other end portion of said seal member.

13. The developer cartridge of claim 9, wherein said seal member is wounded around said shutter member in a direction in which said seal member is movable to open and close said opening, and both the tip end and the root end of each of said end portions of said seal member extend substantially perpendicular to said direction.

14. The developer cartridge of claim 4, wherein said seal member is of a band shape.

15. The developer cartridge of claim 4, wherein said opening is an opening through which said developer stored in said storing portion is taken out.

16. The developer cartridge of claim 4, wherein said shutter member opens and closes said opening from an inside of said storing portion; and said seal member is provided on an outer circumferential surface of said shutter member to seal between said outer circumferential surface of said shutter member and an inner circumferential surface of said storing portion.

17. The developer cartridge according to claim 16, wherein said seal member is wound around said shutter member in a direction in which said seal member is movable to open and close said opening, and both the tip end and the root end of each of said end portions of said seal member extend substantially perpendicular to said direction.

18. The developer cartridge according to claim 4, wherein a side edge of one end portion of said seal member faces a side edge of the other end portion of said seal member.

19. The developer cartridge according to claim 4, wherein said inclined end edges of said end portions of said seal member face each other.

20. The developer cartridge according to claim 19, wherein said inclined end edge extends from said root end to said tip end, and has an inclination in a manner that said width of said tip end is larger than said with of said root end.

21. A developing device using said developer cartridge according to claim 4.

22. An image forming apparatus including said developing device according to claim 21.

* * * * *